US006606107B2

(12) United States Patent
Minowa et al.

(10) Patent No.: US 6,606,107 B2
(45) Date of Patent: Aug. 12, 2003

(54) PRINTING SYSTEM, THERMAL PRINTER, PRINTER CONTROL METHOD, AND DATA STORAGE MEDIUM

(75) Inventors: Masahiro Minowa, Hata-machi (JP); Satoru Imai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/057,641

(22) Filed: Jan. 25, 2002

(65) Prior Publication Data

US 2002/0126197 A1 Sep. 12, 2002

(30) Foreign Application Priority Data

Jan. 26, 2001 (JP) ..... 2001-019032
Jan. 26, 2001 (JP) ..... 2001-019034

(51) Int. Cl.[7] ..... B41J 2/365; B41J 2/315
(52) U.S. Cl. ..... 347/193; 400/120.13
(58) Field of Search ..... 347/193, 188, 347/186, 183, 187; 358/1.9; 101/487; 400/605, 120.01, 120.02, 120.07, 120.09, 120.13

(56) References Cited

U.S. PATENT DOCUMENTS 4,912,485 A 3/1990 Minowa ..... 347/186
5,239,926 A * 8/1993 Nubson et al. ..... 101/487
5,534,890 A 7/1996 Krug et al. ..... 346/100
5,633,670 A 5/1997 Kwak ..... 347/188
5,636,331 A * 6/1997 Klinefelter et al. ..... 358/1.9
6,141,028 A * 10/2000 Aruga ..... 347/193
6,166,753 A 12/2000 Hara ..... 347/193

FOREIGN PATENT DOCUMENTS

JP 63-107568 5/1988
JP 63-216769 9/1988
JP 2-200456 8/1990
JP 3-208675 9/1991

* cited by examiner

*Primary Examiner*—Lamson Nguyen
*Assistant Examiner*—K. Feggins
(74) *Attorney, Agent, or Firm*—Mark P. Watson

(57) ABSTRACT

A printing system, a thermal printer, a printer driver, a printing control method, and a data storage medium control the printing process according to the type of thermal paper that is loaded into the printer when the paper is replaced. By appropriately controlling address selector 1103, a print head controller 811 stores black print pixel data and red print pixel data in first data buffer 1104*a* for storing low energy level print pixel data or second data buffer 1104*b* for storing high energy level print pixel data according to the type of thermal paper in use. A logic circuit unit 1105 outputs the current pattern data to the print head 152 based on the low level print pixel data and high level print pixel data.

10 Claims, 21 Drawing Sheets

(a)

(b)

| | Case-A | Case-B | Case-C | Case-D | Case-E | Case-F |
|---|---|---|---|---|---|---|
| PREVIOUS PRINT COLOR | COLOR (LOW) | COLOR (LOW) | BLACK (HIGH) | BLACK (HIGH) | NONE | NONE |
| PRESENT PRINT COLOR | COLOR (LOW) | BLACK (HIGH) | COLOR (LOW) | BLACK (HIGH) | COLOR (LOW) | BLACK (HIGH) |

"Values in ( ) indicate relative energy levels"

(a)

(b)

| | Case-A' | Case-B' | Case-C' | Case-D' | Case-E' | Case-F' |
|---|---|---|---|---|---|---|
| PREVIOUS PRINT COLOR | BLACK (LOW) | BLACK (LOW) | COLOR (HIGH) | COLOR (HIGH) | NONE | NONE |
| PRESENT PRINT COLOR | BLACK (LOW) | COLOR (HIGH) | BLACK (LOW) | COLOR (HIGH) | BLACK (LOW) | COLOR (HIGH) |

"Values in ( ) indicate relative energy levels"

(a)

(b)

PRINTING SYSTEM, THERMAL PRINTER, PRINTER CONTROL METHOD, AND DATA STORAGE MEDIUM

BACKGROUND OF THE INVENTION

1. Field of the Invention

The present invention relates to a printing system, a thermal printer, a printing control method, and a data storage medium. More particularly, this invention relates to a printing system, a thermal printer, a printing control method, and a data storage medium that apply a printing process appropriate to the type of thermal paper that is loaded in the printer.

2. Description of the Related Art

Line thermal printers and other types of thermal printers ("printers" below) have one or more rows of plural independently driven and heated heat elements. Such printers print by selectively driving (heating) the heat elements to heat a particular spot on thermal paper disposed opposite the driven heat element, thereby producing a desired color on the thermal paper. The colors produced in thermal paper used in this type of printer differ according to the amount of heat energy (applied energy) applied by the heat element. It is therefore possible to change the colors produced on the thermal paper by controlling and changing the applied energy. This is accomplished by varying the pulse width of the current pulses applied to the heat elements.

There are two general types of thermal paper capable of producing two colors, additive color paper (additive type color paper) and subtractive color paper (subtractive type color paper). If the color produced at a low applied energy level is the first color and the color produced at a high applied energy level is the second color, the first color is red or another bright color and the second color is black or another dark color with additive color thermal paper. That is, the second color is the color achieved by adding a specific color to the first color. With subtractive color thermal paper the first color is black or other dark color and the second color is red or another bright color. In other words, the applied energy characteristics of additive color and subtractive color thermal paper are directly opposite. In addition, thermal paper capable of producing three or more colors has been recently proposed.

The operating system used in a computer or other type of data processing terminal provides centralized management and control of system resources shared by various application programs. A software driver is provided for each system resource (such as a peripheral device), and the data processing terminal operates as a device (driver) for managing the resources by running the driver programs.

A printer is one such system resource. An application program running on the data processing terminal is able to print from the printer using a procedure such as described below.

(1) The application program (simply "application" below) sends a print request containing the data to be printed to the operating system. More specifically, the application invokes a system call to the operating system, specifying the address in memory where the print data is stored and such parameters as the amount of data to print.

(2) The operating system invokes a service routine provided by the printer driver, and passes various print data parameters.

(3) The printer driver service routine displays the current printer settings on a display or monitor connected to the data processing terminal, and prompts the user to confirm the printer settings. The settings typically include the paper size and orientation, for example.

(4) If the settings are confirmed, the service routine generates a print command for the selected printer based on the print data and printer settings, and then sends the print command to the printer.

It will thus be obvious that the printer driver functions to relay printer settings and print commands from the application to the printer. The printer driver thus functions as the control unit performing this function using a program containing commands for achieving this function.

By incorporating the printer driver program into a computer or other data processing terminal, the data processing terminal also functions as a printer driver device.

Two-color thermal printers have conventionally been limited to printing with either additive color thermal paper or subtractive color thermal paper. When a thermal printer using one type of thermal paper becomes dominant in the marketplace, the type of thermal paper used by the dominant printer also tends to dominate, becoming widely available while demand for and supplies of the other type of thermal paper drop. For example, if a thermal printer that uses subtractive color thermal paper becomes the market leader, thermal paper supplies become dominated by subtractive color thermal paper while additive color thermal paper becomes less common and not as readily available.

Users of thermal printers that cannot use the type of thermal paper that is most readily available are thus inconvenienced by the need to look for the necessary type of thermal paper because supplies of that type have been reduced. A drop in the supply of that particular type of thermal paper also increases the cost of that particular type, making the paper more expensive for the user. Thermal printers that cannot use the type of thermal paper that is most commonly available are thus extremely inconvenient printers to use.

OBJECTS OF THE INVENTION

With consideration for this problem an object of the present invention is therefore to provide a printing system, a thermal printer, a printing control method, and a data storage medium able to apply a printing process appropriate to the type of thermal paper loaded when the paper is replaced.

SUMMARY OF THE INVENTION

We have researched various solutions for the problems of the related art described above. Through this research we found that printing control suitable for the type of thermal paper loaded in the printer can be achieved by determining the type of thermal paper placed in the printer when the paper is replaced. A function enabling the user to select the thermal paper type can be provided in the printer driver, for example, as a way of achieving printing control matching the type of thermal paper used in the printer.

Print control according to the type of thermal paper loaded in the printer can also be achieved by specifying the print pixel data buffers for separately storing print pixel data for each print color in the print data received from the host computer according to the type of thermal paper in the printer, and controlling the applied energy used to print the colors according to the type of thermal paper.

Furthermore, by controlling printing according to the type of thermal paper used, a thermal printer according to the present invention can use different types of thermal paper, including whichever type of thermal paper is most commonly available.

The invention resulting from this research is described below.

A printing system according to a first aspect of our invention has a printer driver for executing a print request from an application program running on a data processing terminal according to a loaded type of thermal paper; and a thermal printer for controlling printing requested by the application program using the printer driver according to the type of thermal paper loaded when the paper is changed.

The type of thermal paper used in this printing system is preferably monochrome thermal paper, two-color subtractive color thermal paper, or two-color additive color thermal paper.

A thermal printer according to another aspect of the present invention and used in the preceding printing system has (a) a thermal print head having a plurality of heating elements, (b) a paper information storing section for designating (c) a paper type selected from a type of additive two color thermal paper and a type of subtractive two color thermal paper, (d) a first pulse width modulation section for selectively controlling the energy to be applied to each heating element in accordance with energy levels required to obtain the two colors of the subtractive two-color thermal paper, (e) a second pulse width modulation section for selectively controlling the energy to be applied to each heating element in accordance with energy levels required to obtain the two colors of the additive two-color thermal paper, and (f) a buffer selector for selecting either the first or the second pulse width modulation section based on said paper type information.

This printing system also has (g) a paper type determining unit that includes an input control unit that selects either an automatic determining mode or a manual-determining mode.

In this system the paper type determining unit includes a printing control unit that performs the printing by energizing the thermal print head with at least two predetermined levels of applying energy and a printed color detection control unit that reads the printed result to detect the color.

A thermal printer according to another aspect of the present invention and used in the preceding printing system has (a) a data receiving section that receives the print data from a host computer, (b) a paper information memory section that stores at least a relationship between first and second colors and different energy levels to be applied to produce each color, (c) a first print data storing memory section that stores print data for the first color that can be produced by the low energy level, (d) a second print data storing memory section that stores print data for the second color that can be produced by the high energy level, (e) a data input control means for determining one of the print data storing memory sections based on the information stored in the paper information memory section when the print data is received from the host computer, (f) a pulse generating section that generates at least three pulses, (g) a history data storing section that stores at least one occurrence previous print data of each color, (h) a logic circuit that produces a current time period for driving each heating element by choosing one or more pulses corresponding to the present print data and the history data, (h) a driving section that drives each heating element with a low energy level in accordance with the data stored in the first print data storing memory and with a high energy level in accordance with the data stored in the second print data memory section.

In this printer, the data input control unit includes an address exchanging unit that exchanges the addresses of the print data storing memories based on the information stored in the paper information memory section that designates the type of the thermal paper.

In this printer, the paper information memory section designates one of the paper types including subtractive color thermal paper and additive color thermal paper.

The printing system of this invention also has a printer, a print data receiving unit that receives print data from an application program on a host computer, a first print data storing memory that stores the first color print data of a first color produced by a low energy level, a second print data storing memory for storing the second print data of a second color produced by a high energy level, a data storing control unit that selects one of the first and second print data storing memories when inputting the first or, second color print data based on the information stored in the paper information storing section, a printer driver that selectively sends the color print data to the printer, and the print data receiving unit, first print data storing memory, second print data storing memory, data storing control unit and printer driver are included in the host computer.

A printing control method for controlling a thermal printer according to further aspect of this invention comprises (a) a print data receiving step of receiving a print request and print data from an application program, (b) a step of storing the received print data by each color of at least first and second colors to a predetermined memory section to define first and second color print data, (c) a step of determining a paper type of a paper installed in the printer, a step of determining each color data to be produced by a low energy level or high energy level, (d) a step of storing the first color print data in a first print data storing buffer to be energized by a predetermined low energy level, (e) a step of storing the second color print data in a second print data storing buffer to be energized by a predetermined high energy level, and (f) a step of controlling a heating element by driving the heating element in accordance with the color print data stored in the first print data storing buffer in a predetermined first current time period and driving the heating element in accordance with the color print data stored in the second print data storing buffer in a predetermined second current time period that is greater than the first current time period.

A data storage medium according to a further aspect of the invention records (stores) a computer-executable program for executing the printing control method steps of the invention as described herein.

This data storage medium is preferably a Compact Disc (CD), floppy disk, hard disk, magneto-optical disk, Digital Versatile/Video Disc (DVD), magnetic tape, memory card, or other computer readable storage medium.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of the present invention is described below with reference to the accompanying figures. It will be noted that the following embodiments are shown by way of description only and shall not limit the scope of the invention. It will be obvious to one with ordinary skill in the related art that various alternative embodiments can be achieved by replacing some or all of the elements described below with equivalent elements, and that all such variations are included in the scope of this invention.

Figure 1:
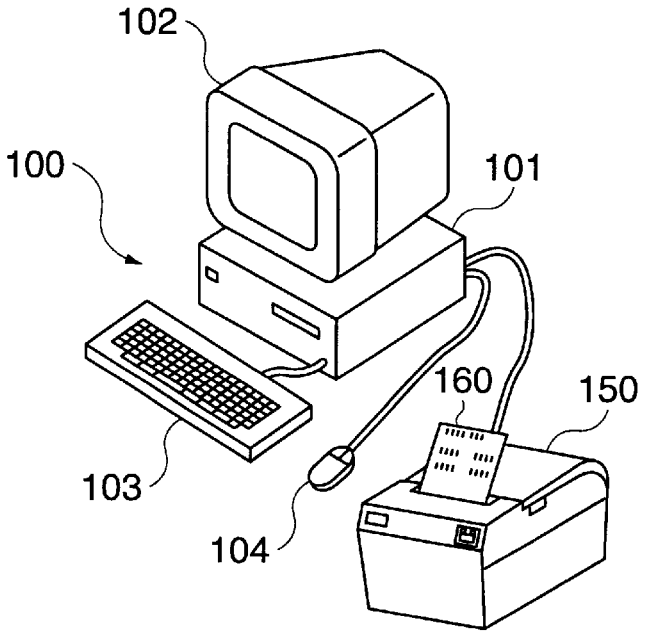
FIG. 1A is a perspective view of a printing system according to the present invention.
FIG. 1B is a vertical section view showing the main parts in a vertical section of the thermal printer shown in FIG. 1A.
Figure 1:
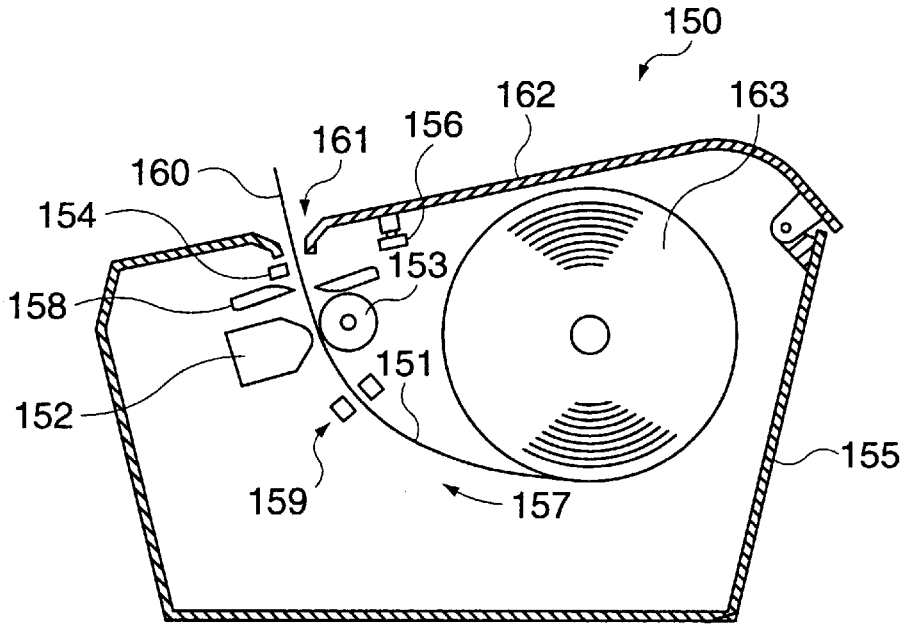

FIG. 1A is a perspective view of a typical printing system having a printer and a host computer, and FIG. 1B is a sectional view of the printer. A printer and a printer driver functioning to relay print settings for the printer and commands from an application for printing to the printer are described below using by way of example a printing system as shown in FIG. 1A.

As shown in FIG. 1A this printing system has a host computer 100 and a printer 150 for printing sales receipts 160, for example. The host computer 100 has a CPU 101, a display 102, a keyboard 103 and a mouse 104. The printer 150 is a peripheral device connected to the host computer 100. The CPU 101 has a floppy disk drive for reading and writing to floppy disks, a CD-ROM drive for reading CD-ROM media, and/or other storage devices, as are well known.

Operation of the printer 150 is described next with reference to FIG. 1B, which is a vertical sectional view showing the main parts of the printer 150. As shown in FIG. 1B thermal paper 151 is supplied on a roll 163 that is loaded inside the printer 150. The thermal paper 151 is fed in the direction of arrow 157 through housing 155 and to the thermal print head 152 (referred to below as the print head). The print data is printed on the thermal paper 151 by the print head 152 when the thermal paper 151 passes between the print head 152 and platen 153. When printing is completed, the thermal paper 151 is cut by a paper cutter 158 disposed downstream of the print head 152. The cut thermal paper 151 is then ejected from paper exit 161 and removed from the printer 150 as a receipt 160.

A paper end sensor 159 is disposed between the roll 163 and print head 152 to detect the end of the thermal paper 151. While not shown in the figure, a near-end sensor could be provided at the side of the roll 163 of thermal paper 151 to detect when the end of the roll is approaching. The near-end sensor can be configured to detect that the end of the thermal paper 151 is nearby detecting when the outside diameter of the roll 163 becomes less than a predefined threshold value as the thermal paper 151 is consumed and the roll 163 diameter decreases.

A color sensor 154 is disposed near the paper exit 161 from which the thermal paper 151 is ejected as a receipt 160 from printer 150. This color sensor 154 is used to determine the type of thermal paper 151 being used. A cover 162 is attached to the printer housing 155, and is closed except, for example, when the thermal paper 151 is being replaced. The cover 162 is closed during printing. A cover open sensor 156 is therefore disposed in the housing 155 for detecting if the cover 162 is open or closed. When the cover open sensor 156 detects that the cover 162 is open, the printer runs a process to pause printing, for example, and automatically goes off-line.

It will be noted that while a printer driver, which functions within the host computer, and a printer are further described below according to a preferred embodiment of the present invention, it will be obvious that other configurations are also possible. The printer driver functions could be provided in the printer, for example, or the printer driver functions could be divided and allocated in part to the host computer and in part to the printer. Yet further, printer driver functions can be achieved in software, hardware, firmware, or ASIC, or in a combination thereof.

An example of a printer driver according to the present invention that functions in a host computer is described next with reference to FIG. 2 to FIG. 7.

Figure 2:
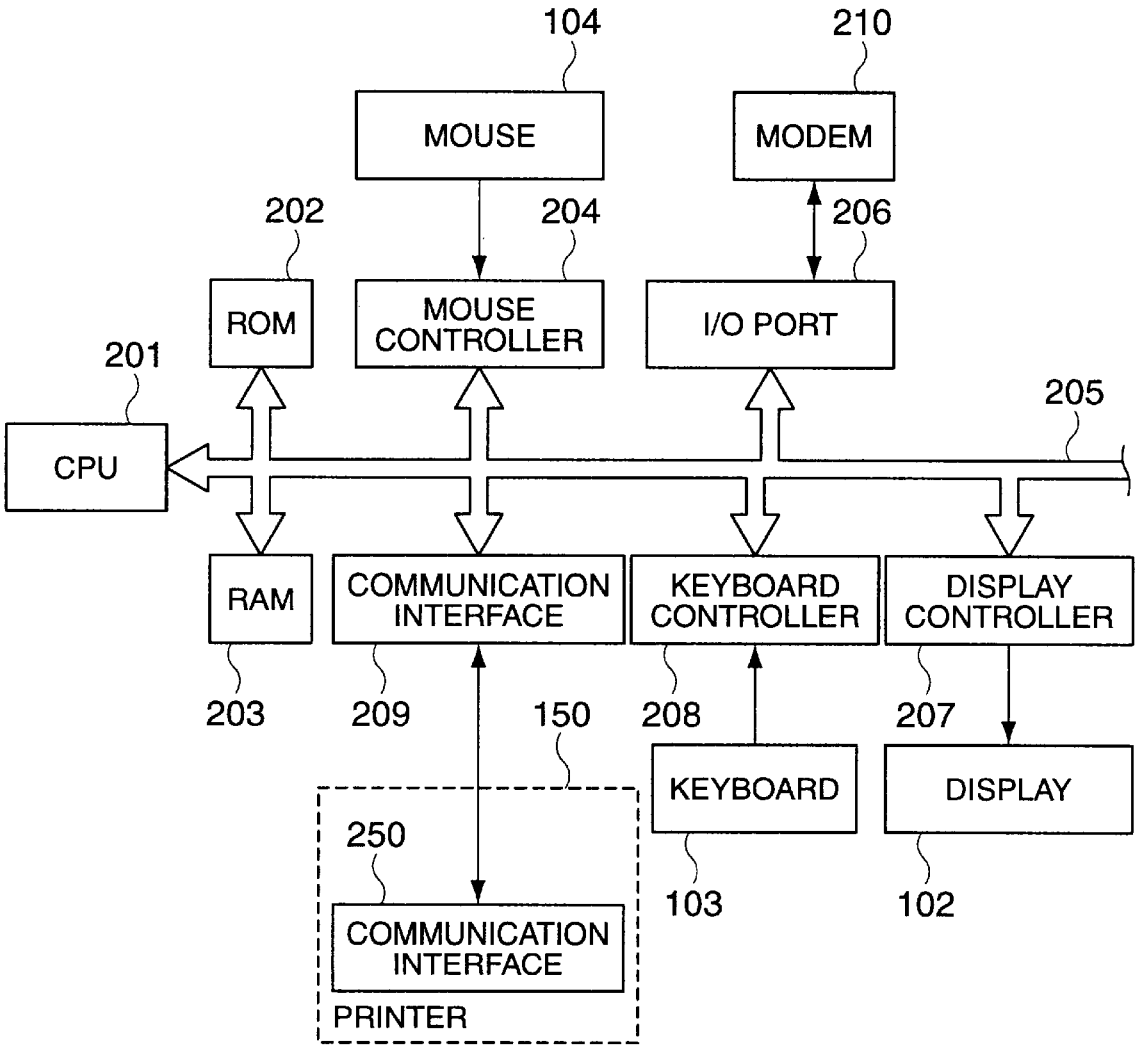
FIG. 2 is a block diagram showing the configuration of a host computer.

FIG. 2 is a schematic block diagram showing the configuration of the host computer. As shown in FIG. 2, connected via bus 205 to the CPU 201 are: ROM 202 for storing program data; RAM 203 in which various storage buffers used for data processing are formed; mouse controller 204 for controlling communication with the mouse 104;

I/O port 206 for connecting to the Internet or other network via a modem 210; display controller 207 for driving and controlling a display 102 to present text and other display data; keyboard controller 208 for capturing key signals corresponding to key input from the keyboard 103; and communication interface 209 for sending print data and commands to the printer 150. Application programs stored in a hard disk drive (not shown in the figure) are run in RAM 203. In addition, the data stored in or to be stored in ROM 202 or RAM 203 could be data stored in or to be stored in a database stored on a hard disk drive (not shown in the figure).

A printer driver according to the present invention has a paper type setting control unit for determining the thermal paper type setting when the paper supply is replaced with one of plural types of thermal paper based on a type detection mode for selecting among plural ways of determining the type of thermal paper, and controlling printing the print information based on the type of thermal paper identified as currently in use.

A printer driver according to the present invention also has: (a) a print request receiving unit for receiving print requests containing print information from an application program; (b) a driver receiving unit for receiving status data from the thermal printer; (c) a settings display control unit for selecting and displaying the thermal printer settings according to the print request received by the print request receiving unit; (d) an input control unit for controlling input of specific data for printing the print information; (e) a print data generating unit for generating the print data sent to the printer based on the thermal printer settings and the specific data for printing the print information; and (f) a driver sending unit for sending the print data and print output commands to the thermal printer.

Figure 3:
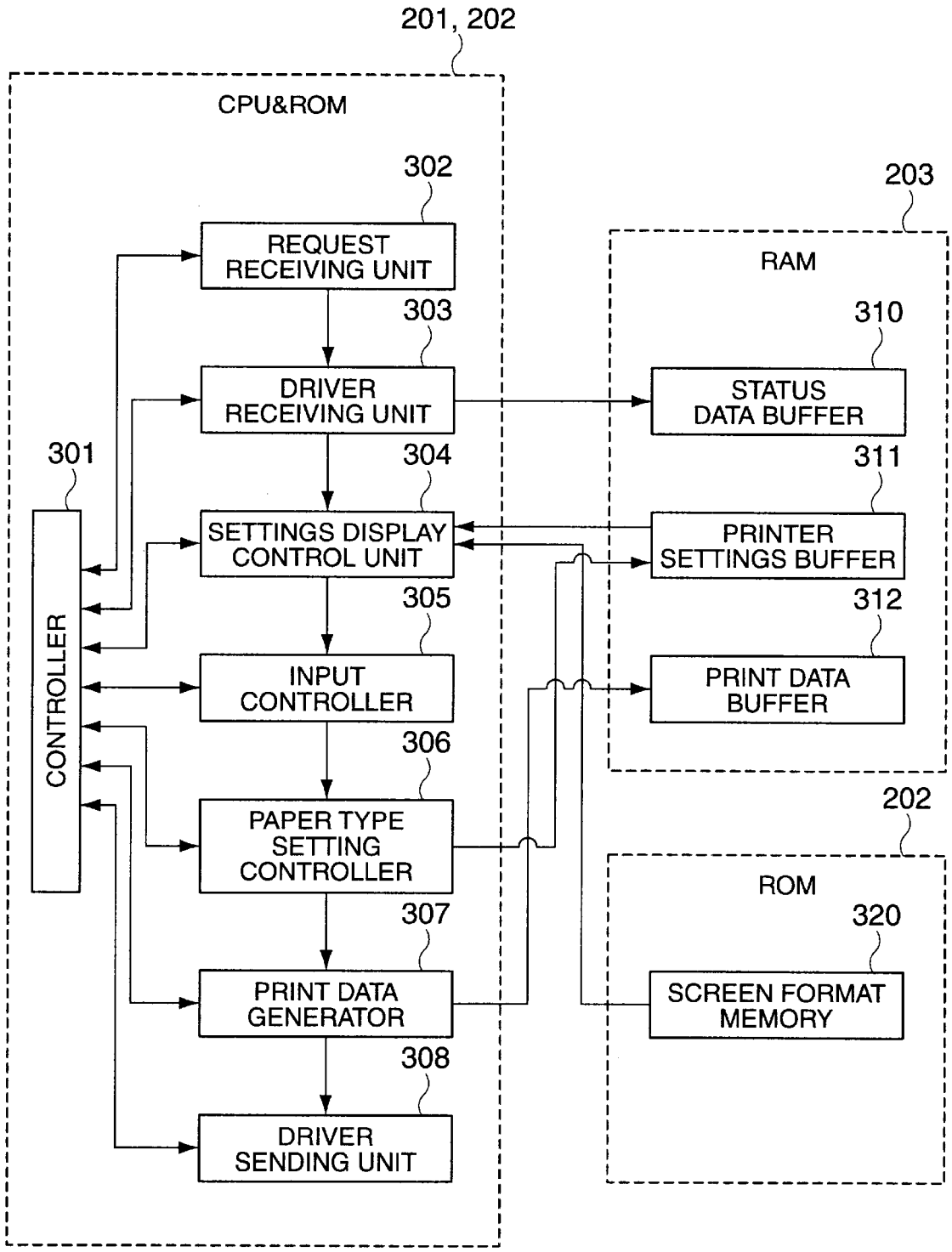
FIG. 3 is a functional block diagram of a printer driver.

FIG. 3 is a block diagram showing one example of printer driver functional units, which are described next below.

As indicated by a dotted line in FIG. 3, CPU 201 and ROM 202 are the principal components that form the functional units including a controller 301, request receiving unit 302, driver receiving unit 303, settings display control unit 304, input controller 305, paper type setting controller 306, print data generator 307, and driver sending unit 308.

The request receiving unit 302 of the CPU 201 receives print requests and the corresponding information to be printed (the print information) sent from the application to the printer. Note that this print information can include text, graphics, photographs, or other type of information.

The driver receiving unit 303 of the CPU 201 receives status data indicating the current printer status from the printer, and stores the status data in a status data buffer 310 in RAM 203.

The settings display control unit 304 of the CPU 201 displays the printer settings for the print information received by the request receiving unit 302 on the display based on the printer status data stored by the driver receiving unit 303 in the status data buffer 310 in RAM 203, the printer settings stored in the printer settings buffer 311 in RAM 203, and the screen format stored in the screen format buffer 320 in ROM 202.

The input controller 305 of the CPU 201 enables the user to select or input desired information to the printer settings displayed by the settings display control unit 304. The type detection mode is a printer setting that determines whether the type of thermal paper set when the paper is changed is an automatic determination made by a paper type detection unit in the printer, or a manual determination made by the user. The set paper type is a printer setting identifying the type of thermal paper loaded in the printer. Selecting the type detection mode and set paper type are further described below with reference to FIG. 6 and FIG. 7.

The paper type setting controller 306 of CPU 201 determines the type of paper loaded in the printer based on the set paper type and type detection mode printer settings input by the input controller 305.

Based on the thermal paper type identified by the paper type setting controller 306, the print data generator 307 of CPU 201 generates the print data to be sent to the printer based on the print information received from the application by first generating print data containing the image data and/or text code data for the print information, and then adding information identifying the type of thermal paper. The resulting print data is then stored in the print data buffer 312 in RAM 203.

The driver sending unit 308 of CPU 201 sends the print data generated by the print data generator 307 together with a print request to the printer.

The controller 301 of CPU 201 controls individual operation and cooperation among the request receiving unit 302, driver receiving unit 303, settings display control unit 304, input controller 305, paper type setting controller 306, print data generator 307, and driver sending unit 308.

The print request relay step for executing a print request from an application program of the data processing terminal to the thermal printer in a print control method of the present invention has a paper type setting control step for determining the type of thermal paper loaded when the paper is replaced with one of plural types of thermal paper, and controlling printing the print information based on the type of thermal paper identified as currently in use.

The print request relay step of a print control method of the present invention also has: (i) a print request receiving step for receiving print requests containing print information from an application program; (j) a settings display control step for selecting and displaying the thermal printer settings according to the print request received by the print request receiving step; (k) an input control step for controlling input of specific data for printing the print information; (l) a print data generating step for generating the print data based on the thermal printer settings and the specific data for printing the print information; and (m) a driver sending step for sending the print data and print output commands to the thermal printer. The print request relay step may additionally have a driver receiving step for receiving status data from the thermal printer.

The settings display control step of the print request relay step in a print control method according to the present invention can also display the set paper type and thermal paper type detection mode, which are controlled by the paper type setting control step.

Yet further, the input control step of the print request relay step in a print control method according to the present invention enables specifying whether the thermal paper type is determined by an automatic determination or a manual determination, and enables selecting a particular thermal paper type from among plural thermal paper types.

Figure 4:
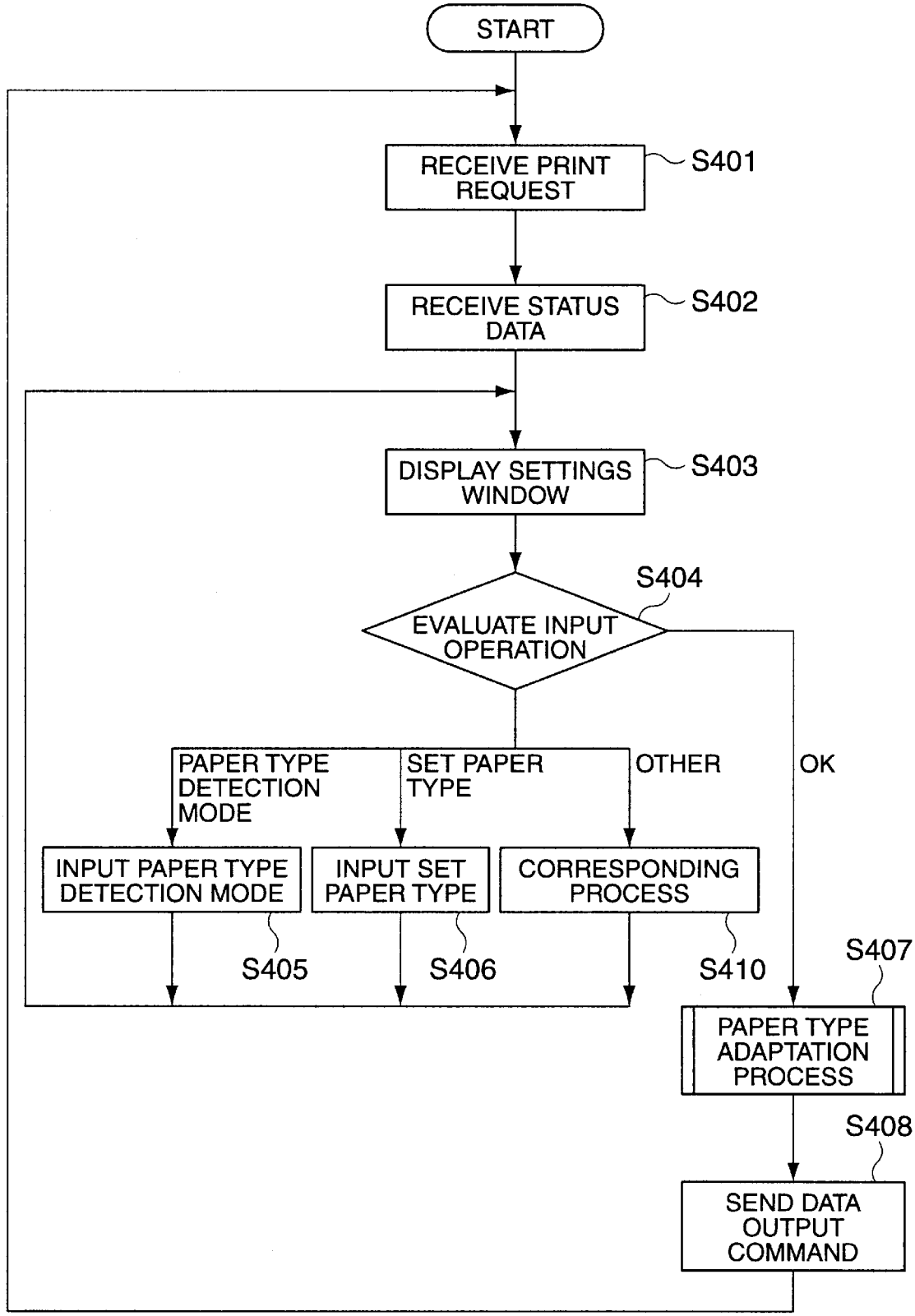
FIG. 4 is a flow chart showing a process for relaying print requests in the printing control process.

FIG. 4 is a flow chart of the print request relay process in the print control method of the present invention.

Once the printer driver (that is, software program) is stored in RAM 203 as part of the operating system, the CPU 201 waits for a print request to be issued by the application (S401). The operating system assumed to be used here is a multitasking system that can allocate CPU 201 time to another program while waiting for a print request. Note that a control routine for allocating CPU time is not shown in FIG. 4. The end of step S401 therefore means that a print request was issued by the application.

Printer status data is received from the printer when a print request is received (S402). Note that printer status data can be received from the printer at regular intervals.

The CPU 201 then presents the printer settings stored in RAM 203 and the printer status data on the display 102 (S403).

The CPU 201 then determines the type of input operation executed by the user with the input device (e.g., whether the type detection mode was selected, or the paper type was set) (S404). The user can change various printer settings as necessary using the keyboard, mouse, or other input device while referring to the printer settings shown on the display. A typical operation for inputting the paper type detection mode and set paper type is further described below with reference to FIG. 6 and FIG. 7.

If the user inputs the paper type detection mode (S404; type detection mode), the specified type detection mode is stored in the printer settings buffer 311 in RAM 203 (S405), and the procedure loops back to S403.

If the user inputs the set paper type (S404; set paper type), the thermal paper type information is stored in the printer settings buffer 311 in RAM 203 (S406), and the procedure loops back to S403.

If some other type of information is input (S404; other), the corresponding process is run (S410), and the procedure loops back to S403.

If the user inputs an "OK" signal to finish inputting printer settings (S404; OK), the printer settings window is closed and the procedure advances to step S407.

When the user ends inputting printer settings (S404 returns OK), CPU 201 generates the print data for printing the print information passed from the application based on the type of thermal paper and other printer settings, and stores the print data in the print data buffer 312 of RAM 203 (S407).

Finally, based on the results from the preceding steps, the CPU 201 sends a print command and the print data stored in the print data buffer 312 of RAM 203 to the printer (S408).

The procedure then loops back to step S401 and the CPU 201 waits for a new print request from the application.

Based on the type detection mode selected for identifying one of plural methods of determining the type of thermal paper, the print request relay step of the print control method of this invention can determine whether the thermal paper is monochrome, two-color subtractive color thermal paper, or two-color additive color thermal paper.

Figure 5:
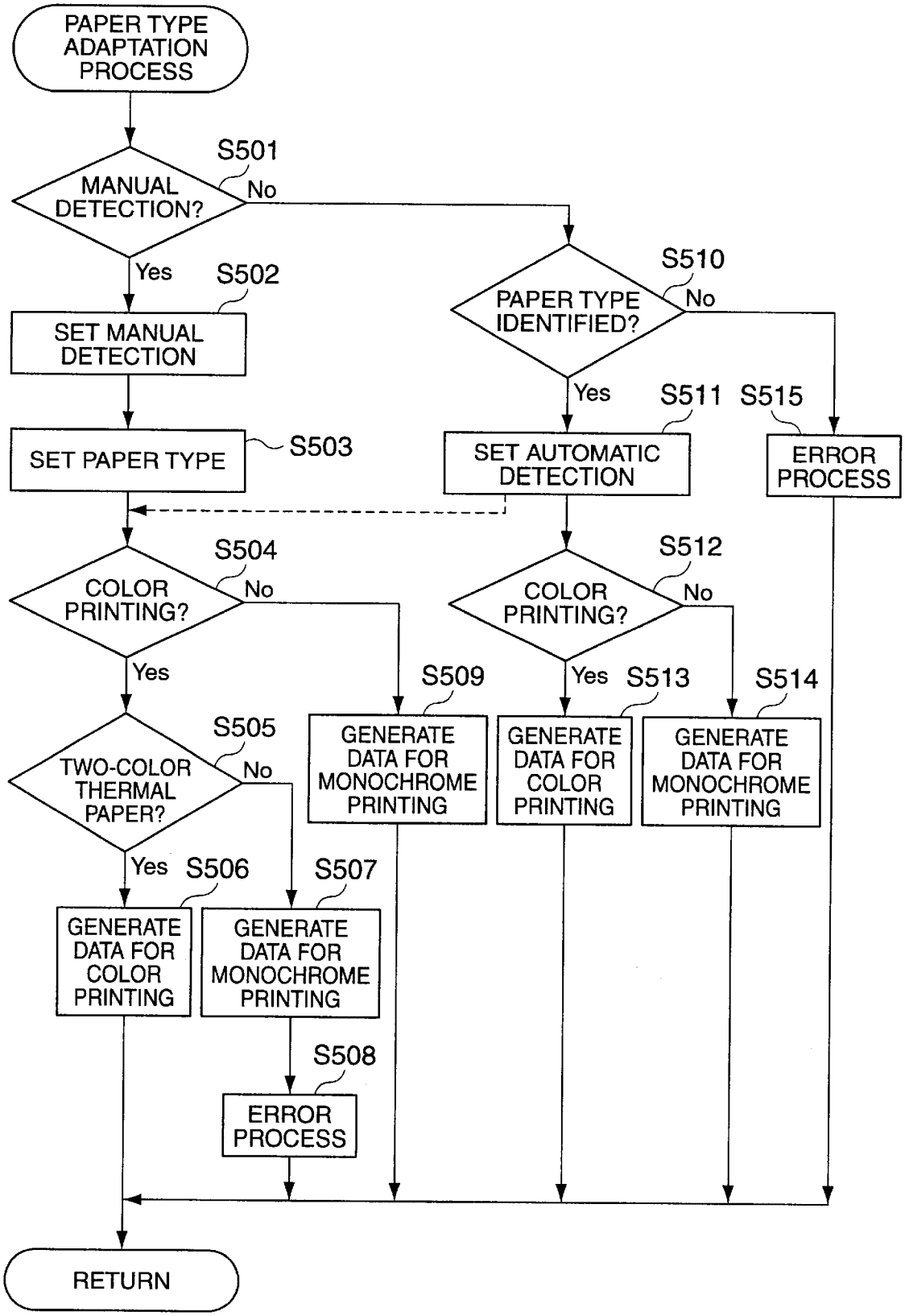
FIG. 5 is a flow chart showing a paper type adaptation process in the print request relay process.

FIG. 5 is a flow chart of the paper type adaptation process in the print request relay process.

The first step is to decide if the type of thermal paper loaded in the printer is to be determined manually or automatically (S501). If the paper type is to be set manually (S501 returns yes), that is, "manual determination" is selected as the type detection mode, the paper type detection mode for the print data is set to "manual" (S502), and the selected type of thermal paper is set for the set paper type in the print data (S503).

Whether to print the print information in color or monochrome is then determined (S504). If color printing is selected (S504 returns yes), the type of thermal paper specified is detected, that is, whether two-color thermal paper (specifically, subtractive type color or additive type color thermal paper producing two colors) or monochrome thermal paper is specified (S505).

If two-color subtractive or additive color paper is specified (S505 returns yes), print data for color printing is generated (S506), and the paper type adaptation process ends.

If monochrome thermal paper is specified (S505 returns no), print data for monochrome printing is generated (S507), an error process reporting that color printing is not possible is run (S508), and the paper type adaptation process ends.

If monochrome printing is selected for the print information (S504 returns no), print data for monochrome printing is generated (S509), and the paper type adaptation process ends.

If the type of thermal paper loaded in the printer is to be determined automatically (S501 returns no), that is, if "automatic determination" is selected as the type detection mode, step S510 detects whether a paper type detection unit in the printer for determining the type of thermal paper was able to identify the type of thermal paper loaded in the printer.

If the paper type detection unit in the printer for determining the type of thermal paper is not able to identify the type of thermal paper loaded in the printer (S510 returns no), an error process for reporting that automatic determination is not possible is run (S515), and the paper type adaptation process ends. In this case the user can select manual determination for the type detection mode to manually select the set paper type. It should be noted that the type of thermal paper loaded in the printer cannot be detected when, for example, the paper type detection unit for detecting the thermal paper type is not installed in the printer, the type detection unit cannot be used because of a malfunctioning sensor or other component, or the detection result is unable to identify the paper type. Whether the paper type is successfully automatically detected can be determined from the status data received from the printer.

If the paper type detection unit in the printer for determining the type of thermal paper was able to identify the type of thermal paper loaded in the printer (S510 returns yes), the print data paper type detection mode is set to automatic determination (S511).

Whether to print the print information in color or monochrome is then determined (S512). If color printing is selected (S512 returns yes), print data for color printing is generated (S513), and the paper type adaptation process ends. If the information is to be printed in monochrome (S512 returns no), print data for monochrome printing is generated (S514) and the paper type adaptation process ends.

It should be noted that as indicated by the dotted line in FIG. 5 the paper type adaptation process could be written so that instead of moving from step S511 to S512, control flows to step S504 so that print data for the print information is generated according to the identified type of thermal paper.

It will be further noted that the settings display control unit of a printer driver according to the present invention can also display the set paper type and paper type detection mode controlled by the paper type setting control unit.

Furthermore, the input control unit of a printer driver according to the present invention can specify whether the thermal paper type is identified by an "automatic determination" or by a "manual determination."

Yet further, the input control unit of a printer driver according to the present invention can select the desired thermal paper type, specifically whether the thermal paper is monochrome, two-color subtractive color paper, or two-color additive color paper.

Figure 6:
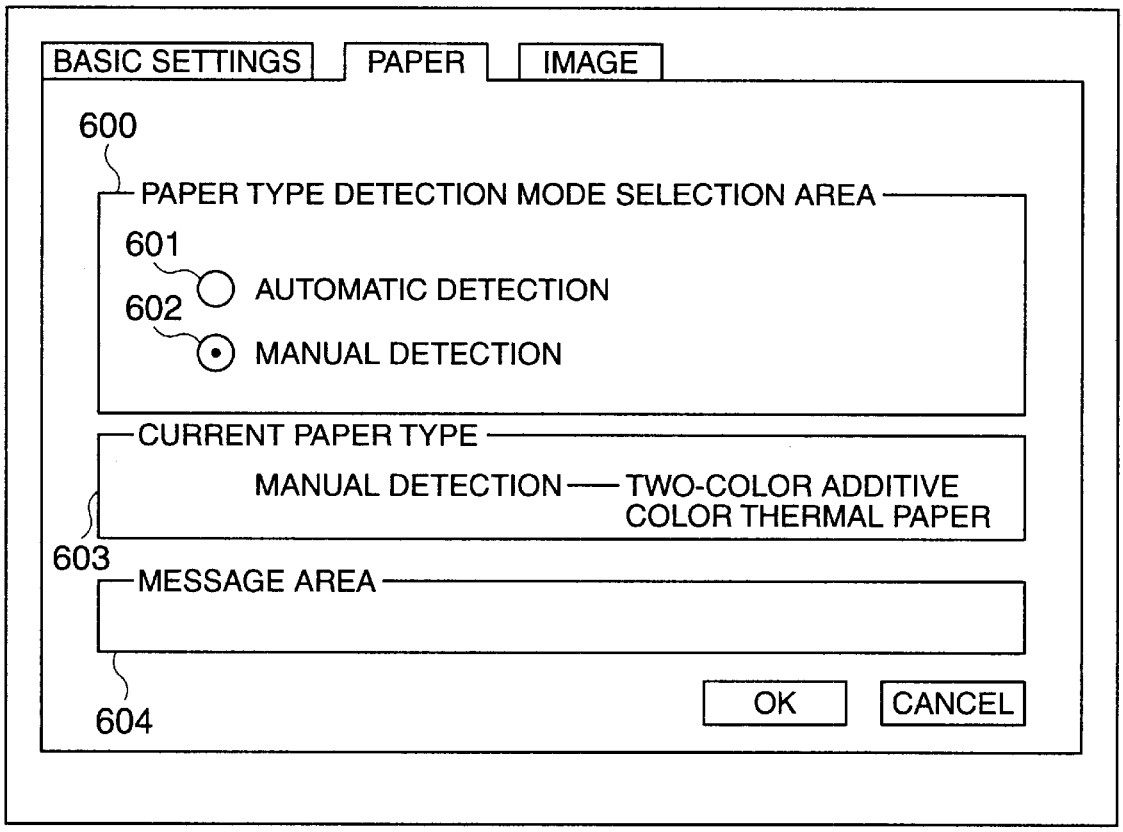
FIG. 6 shows a typical screen shot of a window for selecting the paper type detection mode.

An example of a screen for selecting the paper type detection mode is shown in FIG. 6.

As shown in FIG. 6 the paper type detection mode selection area 600 of this screen has a control 601 for selecting the automatic determination mode, and a control 602 for selecting the manual determination mode. If manual determination is selected, a window for selecting the set paper type is presented as shown in FIG. 7.

Information about the paper currently loaded in the printer is shown in the "current paper type" area 603. The example shown in FIG. 6 indicates that the manual determination mode is currently selected and two-color additive color thermal paper is selected as the paper type.

Error messages, prompts, or other information can be presented in the message area 604 of this screen. For example, if automatic determination is selected but the paper type detection unit cannot be used because of a sensor malfunction, a prompt telling the user to switch the paper type detection mode to the manual mode could be displayed. In the example shown in FIG. 6, the selected paper type detection mode is made active when the OK button is operated.

Figure 7:
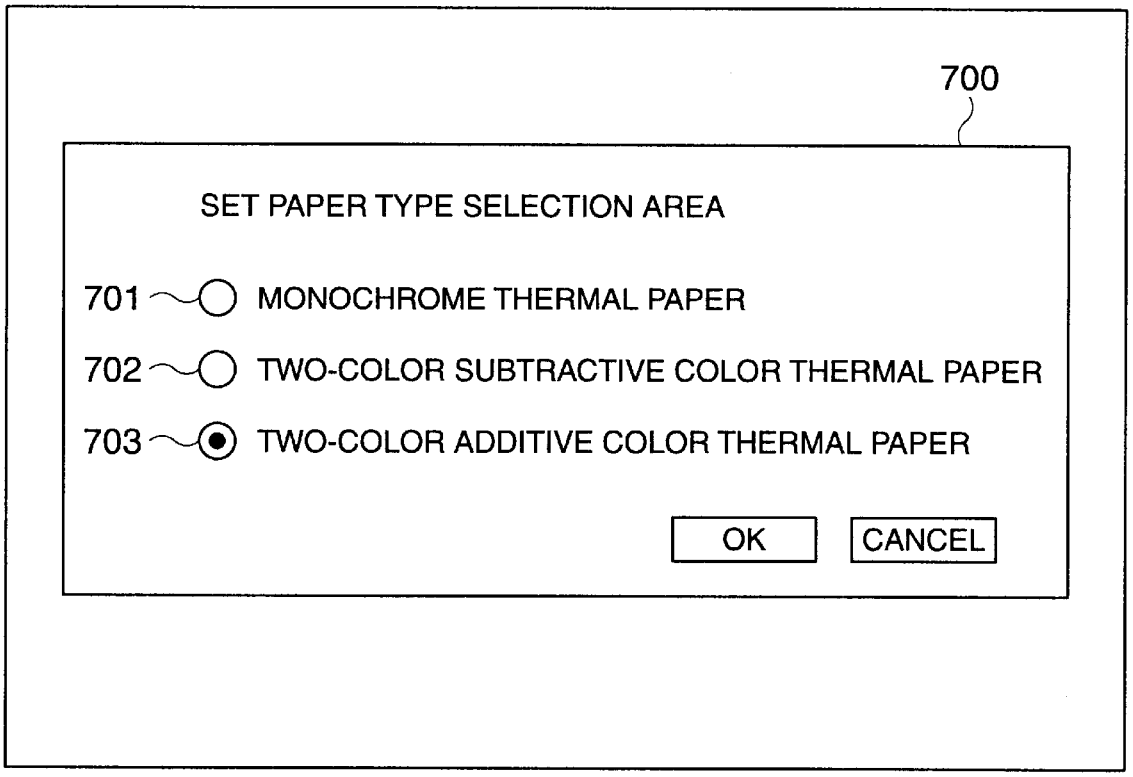
FIG. 7 shows a typical screen shot of a window selecting the set paper type.

A window for manually selecting the set paper type is shown in FIG. 7 by way of example.

As shown in FIG. 7 the set paper type selection area 700 has a control 701 for selecting monochrome thermal paper, a control 702 for selecting two-color subtractive color thermal paper, and a control 703 for selecting two-color additive color thermal paper. The selected thermal paper type is confirmed and made active when the OK button is operated.

Figure 8:
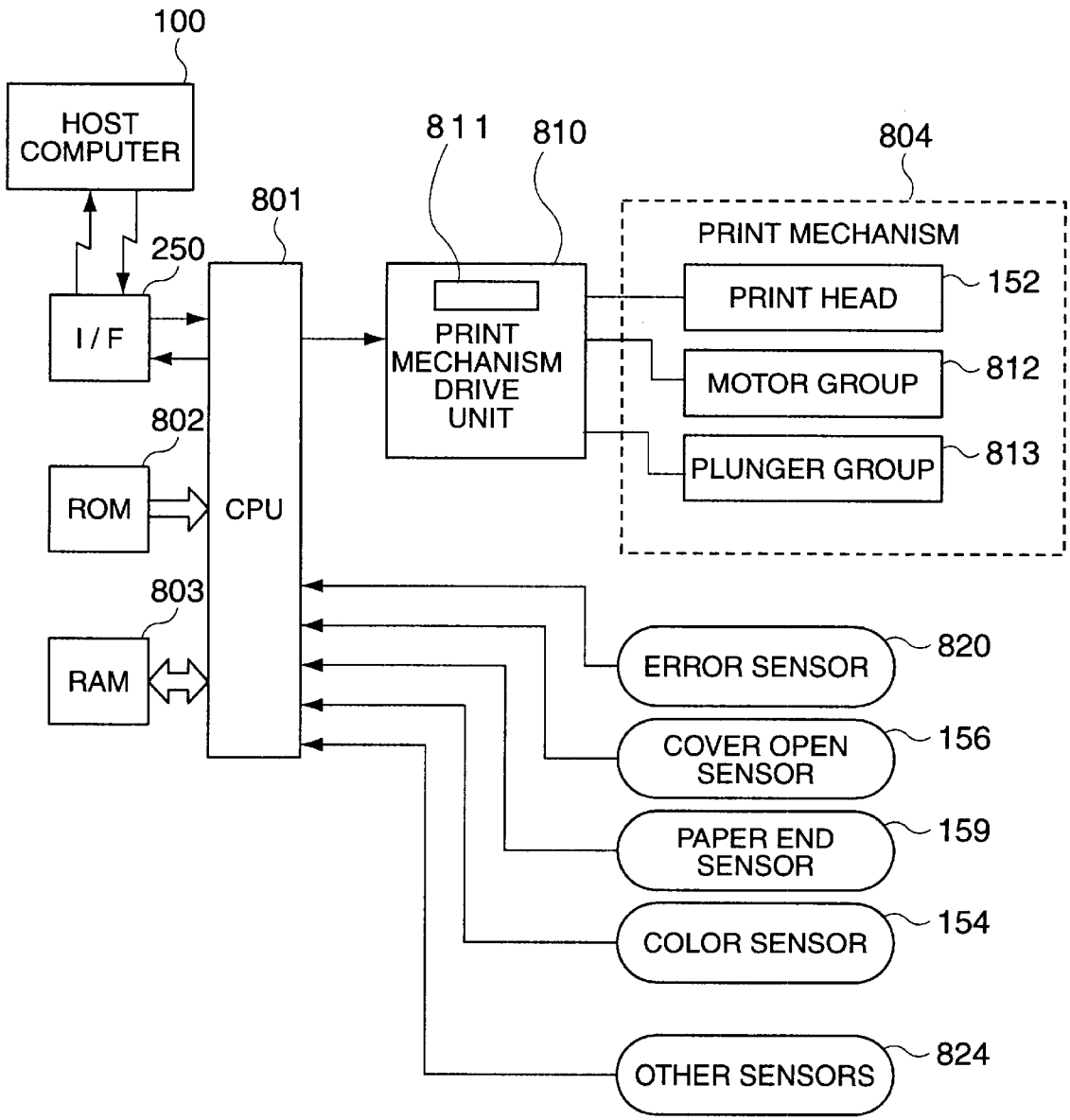
FIG. 8 is a schematic block diagram of a thermal printer.

A preferred embodiment of a printer according to the present invention is described next below with reference to FIG. 8 to FIG. 20. FIG. 8 is a schematic block diagram showing the configuration of this printer.

As shown in FIG. 8 the print mechanism 804 for transporting, printing, and cutting the thermal paper and performing other mechanical operations has a print head 152, motor group 812, plunger group 813, and print mechanism drive unit 810 for driving these other parts has a print head controller 811 as a head control section. An error sensor 820, cover open sensor 156, paper end sensor 159, color sensor 154, and other sensors 824 are connected to the CPU 801. These sensors detect such events as paper jams and other errors, and whether the cover is open, and input the detection results to the CPU 801.

ROM 802 stores the software (including firmware) and data used to achieve various printer functions. The CPU 801 reads the software and data and runs the software program to achieve the printer functions.

RAM 803 functions as temporary storage for data required to perform the printer functions.

The CPU, ROM, and RAM of a printer according to the present invention are described next with reference to FIG. 9 and FIG. 10, and the print head controller and print head of the printer are described with reference to FIG. 11 to FIG. 21.

A thermal printer according to the present invention has (a) a status data detection unit for detecting status data indicating the status of one or more of the plural sensors, (b) a printer driver for executing print requests sent to the thermal printer from an application running on the data processing terminal, (c) a data receiving unit for receiving print data from the printer driver for printing the print information passed from the application, (d) a paper type detection unit for detecting the type of thermal paper loaded when the paper was changed based on the print data received by the data receiving unit, (e) set paper type memory for storing the thermal paper type identified by the paper type detection unit until the paper is next changed, and (f) a data sending unit for sending status data detected by the status detection unit and the thermal paper type identified by the paper type detection unit to the printer driver.

The paper type detection unit of the thermal printer according to the present invention can identify the type of thermal paper based on the paper setting mode determining the type of thermal paper in the print data, and the status data detected by the status detection unit.

Figure 9:
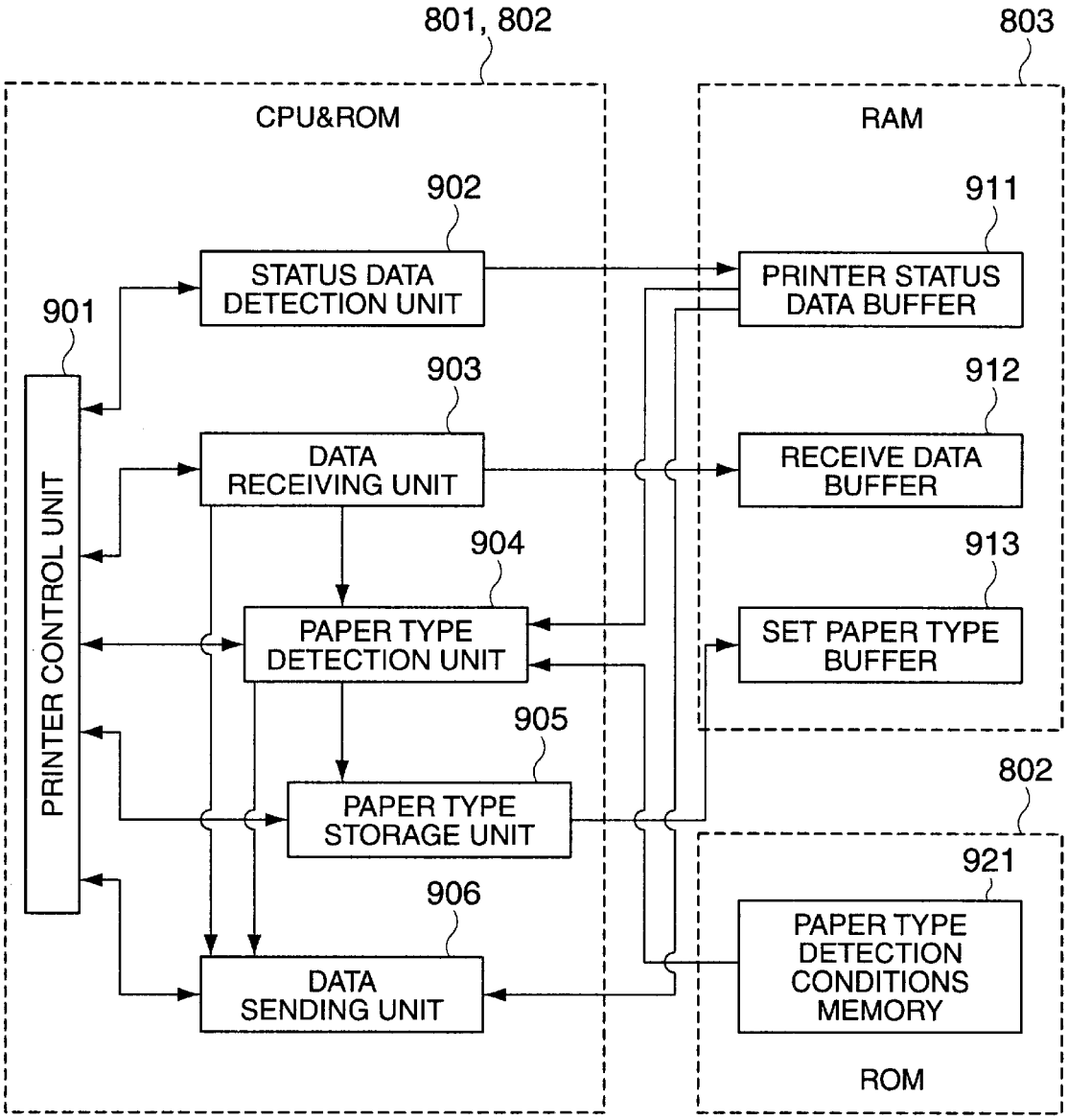
FIG. 9 is a function block diagram of a thermal printer.

FIG. 9 is a schematic block diagram showing an example of the functions of the CPU and ROM in a printer according to the present invention. These functions are described next below.

As shown in FIG. 9 the CPU 801 has a printer control unit 901, status data detection unit 902, data receiving unit 903, paper type detection unit 904, paper type storage unit 905, and data sending unit 906.

The status data detection unit 902 of the CPU 801 detects sensor status data output from various sensors connected to the CPU 801, including the error sensor 820, cover open sensor 156, paper end sensor 159, color sensor 154, and other sensors 824 as shown in FIG. 8, and stores the detected status data in the printer status data buffer 911 allocated in RAM 803.

The data receiving unit 903 of CPU 801 stores data received from the host computer 100 in the receive data buffer 912 allocated in RAM 803.

When the paper type detection mode is set to automatic determination in the received print data, the paper type detection unit 904 of CPU 801 determines the type of thermal paper loaded in the printer when the paper was changed based on the status data stored in the printer status data buffer 911 in RAM 803 and the paper type detection conditions stored in the paper type detection conditions buffer 921 in ROM 802.

In automatic paper type determination, the paper type is determined by the paper type detection unit 904 that executes the following operations. The printer's CPU 801 has a control section that performs printing by energizing the print head by at least two predetermined levels of energy and detects the colors of the resulting printed portions by using the color sensor 154. When the portion printed caused by the lower energy level is detected as black color and the portion printed by the higher energy level is detected as red color, the CPU 801 judges that the paper is of the subtractive type of two-color thermal paper. When the portion printed by the lower energy level is detected as red color and the portion printed by the higher energy level is detected as black color, the CPU 801 judges that the paper is of the additive type of two-color thermal paper type. When both portions are detected as black color, the paper is monochrome black paper.

The paper type storage unit 905 of CPU 801 stores the thermal paper type determined by the paper type detection unit 904 to the set paper type buffer 913 in RAM 803 and/or to flash memory when the paper type detection mode is set to automatic determination in the received print data, and stores the set paper type contained in the received data when the paper type detection mode is set to manual determination in the received print data.

The data sending unit 906 of CPU 801 sends the paper type determined by the paper type detection unit 904 and any status data reports to the host computer 100.

The printer control unit 901 of CPU 801 controls individual operation and cooperation among the status data detection unit 902, data receiving unit 903, paper type detection unit 904, paper type storage unit 905, and data sending unit 906.

A printing control method according to the present invention has (a) a status data detection step for detecting status data indicating the status of one or more of the plural sensors, (b) a print request relay step for executing print requests sent to the thermal printer from an application running on the data processing terminal, (c) a data receiving step for receiving print data from the print request relay step for printing the print information passed from the application, (d) a paper type detection step for detecting the type of thermal paper loaded when the paper was changed based on the print data received by the data receiving step, (e) a paper type storage step for storing the thermal paper type identified by the paper type detection step until the paper is next changed, and (f) a data sending step for sending status data detected by the status data detection step and the thermal paper type identified by the paper type detection step to one or more specified locations.

The paper type detection step of the printing control method of the present invention can identify the type of thermal paper based on the paper setting mode determining the type of thermal paper in the print data, and the status data detected by the status data detection step.

Figure 10:
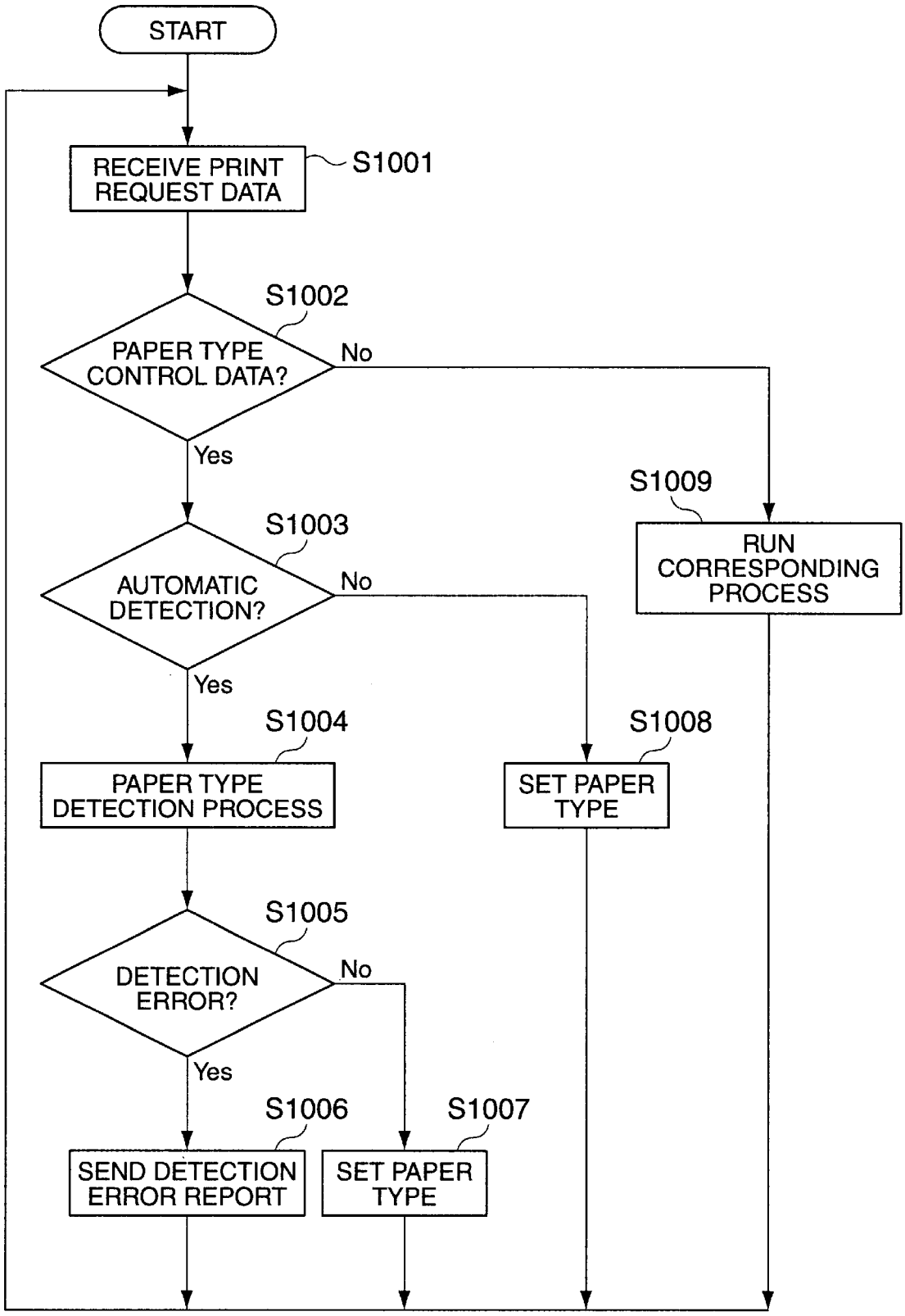
FIG. 10 is a flow chart of a process for determining the type of thermal paper loaded in the printer when the paper is changed.

FIG. 10 is a flow chart of the process for determining the type of thermal paper loaded into the printer when the paper is changed.

The first step is receiving print request data from the host computer (S1001), and then detecting if the paper type detection mode and set paper type for determining the paper type are contained in the received print data (S1002). If information for determining the thermal paper type is not contained in the received data (S1002 returns no), another process appropriate to the received data is run (S1009). The procedure then loops back to step S1001, and waits until new data is received.

If information for determining the thermal paper type is contained in the received data (S1002 returns yes), whether the paper type detection mode in the received data is set to automatic or manual is detected (S1003). If the paper type detection mode is set to manual in the received data (S1003 returns no), the set paper type in the received data is stored as the type of thermal paper in the set paper type buffer 913 of RAM 803 and/or to flash memory (S1008). The procedure then loops back to step S1001, and waits until new data is received.

If the paper type detection mode is set to automatic in the received data (S1003 returns yes), the type of thermal paper loaded into the printer when the paper was changed is determined based on the status data stored in the printer status data buffer 911 in RAM 803 and the paper type detection conditions stored in the paper type detection conditions buffer 921 of ROM 802 (S1004). The type of thermal paper can be determined automatically by, for example, printing a test sample on the thermal paper and then using the color sensor 154 to detect the color(s) in the printed output. Whether the paper is monochrome thermal paper, two-color subtractive color thermal paper, or two-color additive color thermal paper can be determined from the applied energy and the resulting colors printed in the test sample.

Step S1005 then determines if an evaluation error occurred in step S1004 for determining the thermal paper type. An evaluation error as used here means that the type of thermal paper could not be determined. If an evaluation error occurred (S1005 returns yes), that is, the type of thermal paper could not be determined, the evaluation error is reported to the host computer (S1006). If an error did not occur (S1005 returns no), that is, the type of thermal paper was identified, the thermal paper type is stored in the set paper type buffer 913 in RAM 803 and/or flash memory (S1007). The procedure then loops back to step S1001, and waits until new data is received.

A thermal printer according to a further embodiment of the present invention has (a) a data receiving unit for receiving print data sent from a host computer, (b) a print pixel data storage unit, (c) an applied energy control unit, and (d) a print head controller. The print pixel data storage unit extracts the print pixel data for each printed color from the print data received by the data receiving unit, and stores the pixel data in specific data buffers. The applied energy control unit controls the applied energy level, that is, the amount of energy to apply to a particular pixel to produce a particular color in the thermal paper, based on the specified type of thermal paper and the print pixel data for each color pixel stored by the print pixel data storage unit. The print head controller drives the print head to produce a particular color in a specified area of the thermal paper based on current pattern data, which indicates the applied energy level set by the applied energy control unit.

This thermal printer preferably also has (a) a paper type detection unit for determining the type of thermal paper loaded in the printer, and (b) paper type memory for storing the type of thermal paper identified by the paper type detection unit.

Yet further preferably, the type of thermal paper used in a thermal paper according to the present invention is monochrome thermal paper, two-color subtractive color thermal paper, or two-color additive color thermal paper.

Figure 11:
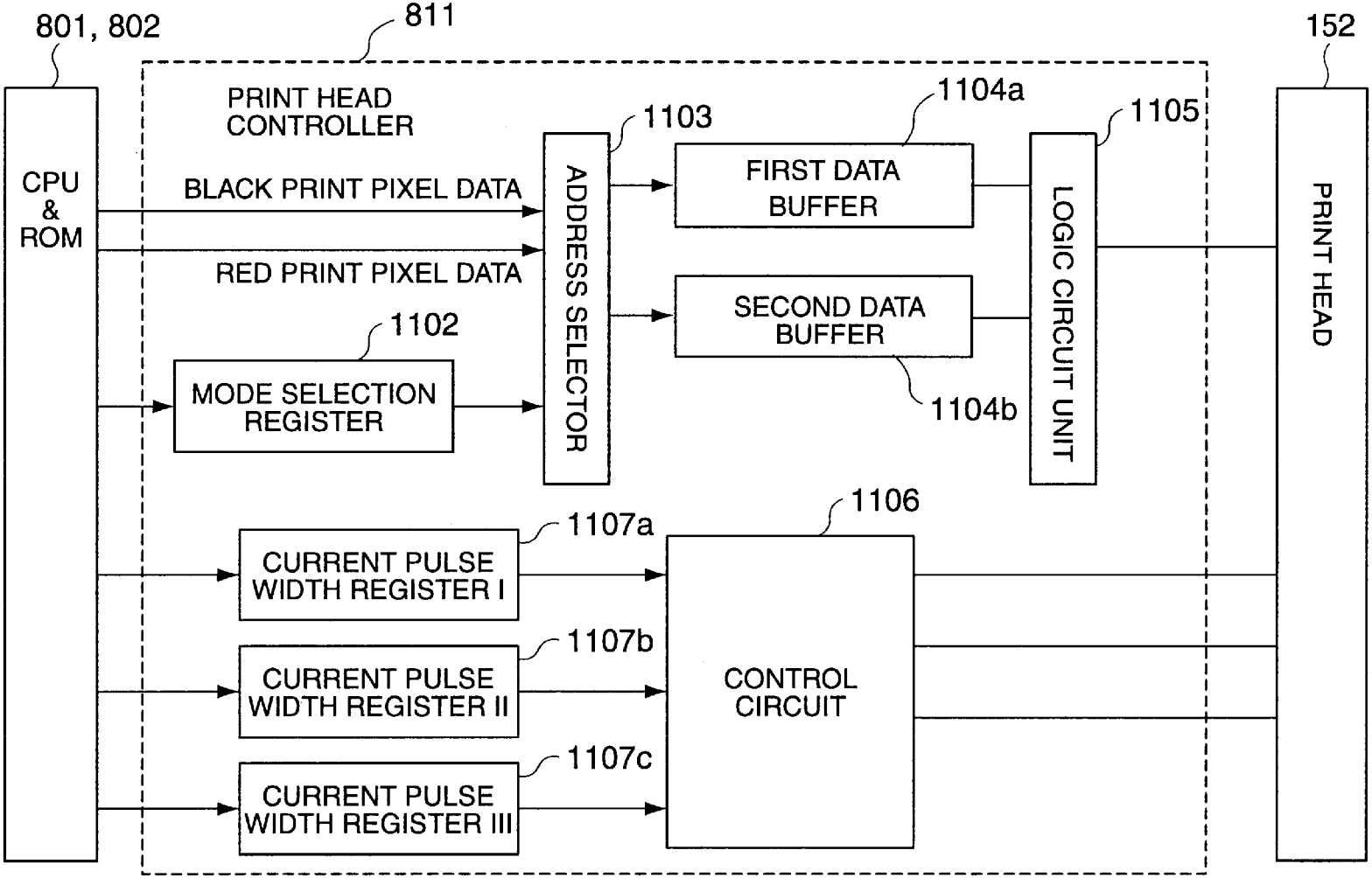
FIG. 11 is a schematic block diagram of the print head controller in a printer according to the present invention.

FIG. 11 is a schematic block diagram showing the configuration of the print head controller 811 in a printing system including this thermal printer and the printer driver included in a host computer. The print head controller in this embodiment is mainly constituted of a firmware implemented in a printer unit.

As shown in FIG. 11, the print pixel data generated from the print data received from an application execution section (an application program) on the host computer 100 (FIG. 8) by way of CPU 801 and ROM 802 is corrected by the print head controller 811, which functions as the applied energy control unit, based on data representing the printing history. The print head controller 811 then passes the corrected current pattern data to the print head 152. A printer that can use either two-color additive color thermal paper or two-color subtractive color thermal paper is described below where the two different printed colors are assumed to be black and red.

As described above with reference to FIG. 9, the thermal paper type is determined by the paper type detection unit or paper type set switch, for example, included in the printer as the paper type detection unit 904, and is stored in the set paper type buffer 913 by paper type storage unit 905. The CPU 801 and ROM 802 then write this thermal paper type to the mode selection register 1102 as the paper type information including at least the paper type, printable colors, and the relationship between each color and the respective energy level. For example, it contains the information representing that the paper set in the printer is a subtractive one, printable colors are black and red and the energy for black color is smaller than that for red color.

Based on the print data received from the host computer 100, the CPU 801 and ROM 802 generate black and red print pixel data, and store the black and red pixel data in first and second data buffers respectively. Based on the thermal paper type (referred to below as the "paper type mode") stored in the mode selection register 1102, the print head controller 811 stores one line of black print pixel data in first data buffer 1104*a* or second data buffer 1104*b*, and stores one line of red print pixel data in the other data buffer by appropriately controlling a buffer selector functioning as address selector 1103. More specifically, the print head controller 811 determines if the black print pixel data or the red print pixel data is the low energy level print pixel data, that is, which color is produced at the low applied energy level, and which is the high energy level print pixel data, that is, which color is produced at the high applied energy level. Based on the result, the low energy level print pixel data is stored in first data buffer 1104*a* for the low applied energy level, and the high energy level print pixel data is stored in second data buffer 1104*b* for the high applied energy level. For example, if additive color paper is used, the print pixel data for red, the color produced at the low applied energy level, is the low energy level print pixel data and is therefore stored in first data buffer 1104*a*, and the print pixel data for black, that is, the high energy level print pixel data, is stored in second data buffer 1104*b*. If subtractive color paper is used, the black print pixel data is the low energy level print pixel data and is stored in the first data buffer 1104*a*, and the red or high energy level print pixel data is therefore stored in second data buffer 1104*b*.

Note that a low applied energy level as used herein refers to a specific first applied energy level in an energy range that can produce a first color designated as a low level energy color. A high applied energy level as used herein refers to a specific second applied energy level, higher than the first energy level, in an energy range that can produce a second color designated as a high level energy color.

The print head controller 811 generates and outputs current pattern data to the print head 152 using logic circuit unit 1105 based on the low energy level print pixel data stored in first data buffer 1104*a*, and the high energy level print pixel data stored in second data buffer 1104*b*.

It is thus possible based on the type of thermal paper stored in the mode selection register 1102, that is, whether additive color paper or subtractive color paper is used, to change the storage buffer used for the black print pixel data and the storage buffer used for the red print pixel data, and thereby control printing appropriately to the type of thermal paper used. Furthermore, in addition to changing the data storage buffers used for the black print pixel data and the red print pixel data, control appropriate to the type of thermal paper can be achieved by changing the data register storing the address of the memory area storing the black print pixel data and the data register storing the address of the memory area storing the red print pixel data. That is substantially the same as the exchanging of the buffers.

It will be noted that the applied energy is based on the amount of time that current is supplied to the heating elements of the print head 152. As a result, control circuit 1106 outputs a timing signal to the print head 152 to control the current supply time based on the different current pulse widths stored in current pulse width register I 1107*a*, current pulse width register II 1107*b*, and current pulse width register III 1107*c*.

While a logical expression for determining one or more pulses are described later in detail, the output pulses of the current pulse width register I 1107*a*, current pulse width register II 1107*b*, and current pulse width register III 1107*c* are selected to form a present current pulse corresponding to the past energized history and the energy level in the past and the present of each heating element so that the current pulse width of each heating element is modulated.

In the above embodiment of this invention, the print head controller is explained as a hardware circuit in the printer unit. However, it is possible to separate a part of the print head controller and install it on a host computer as a part of the memory or the function of the printer driver. For example, part of the host computer's memory can be used for implementing the first and second buffers, and the printer driver can execute the functions for address exchanging or determining the paper type. The printer unit controls printing based on the data received from the host computer corresponding to the information as to whether the color data is of the high energy level color data or the low energy level color data.

The print mechanism drive circuit of a thermal printer according to the present invention preferably has (a) heating elements for producing color in a specific area of the thermal paper, (b) a heating element drive unit corresponding to each heating element for driving the heating element, and (c) a current pattern data memory for storing the current pattern data output from the applied energy control unit.

Figure 14:
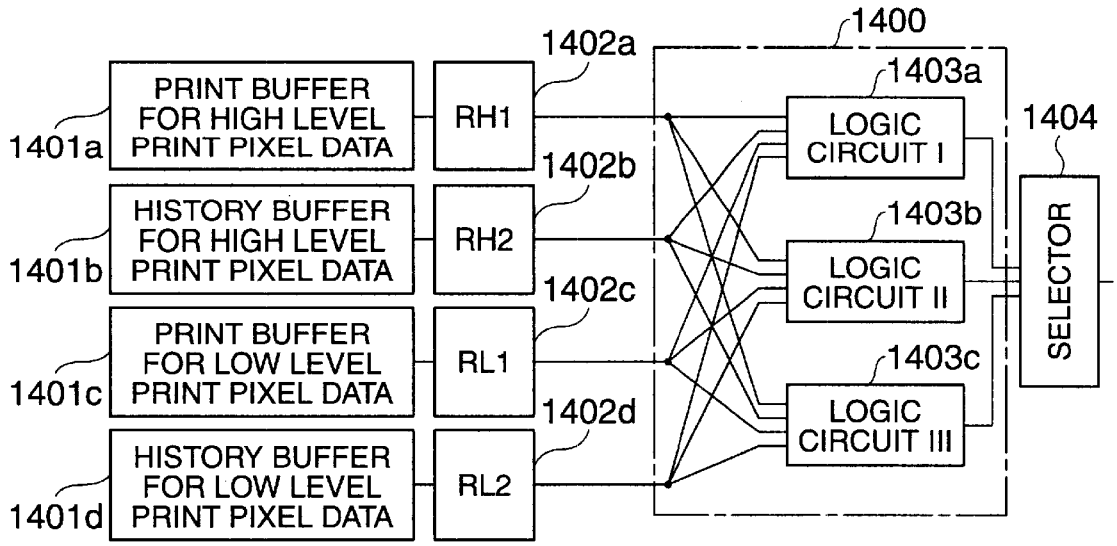
FIG. 14 shows the internal configuration of a general-purpose two-color logic circuit.

FIG. 14 is a block diagram describing one embodiment of a two-color logic circuit in the case where the print head controller 811 is constituted of a hardware circuit in the printer. The logic circuit is of a general purpose type for any type of two-color thermal paper.

As shown in FIG. 14, a general purpose two-color logic unit 1400 has three logic-circuits, logic circuit I 1403*a*, logic circuit II 1403*b*, and logic circuit III 1403*c*. Pixel data stored in control register RH1 1402*a*, control register RH2 1402*b*, control register RL1 1402*c*, and control register RL2 1402*d* is input to each logic circuit. The logic circuits then output a current pattern data, based on the logic operation shown below. Output data from logic circuit I 1403*a*, logic circuit II 1403*b*, and logic circuit III 1403*c* is referenced below as OI, OII and OIII. Control register RH1 1402*a* stores the present line of print pixel data for the color produced at the high applied energy level (referred to as "high level print pixel data"), control register RH2 1402*b* stores the previous line of high level print pixel data, control register RL1 1402*c* stores the present line of print pixel data for the color produced at the low applied energy level (referred to as "low level print pixel data"), and control register RL2 1402*d* stores the previous line of low level print pixel data. The present low level print pixel data is denoted below as DLn, the previous low level print pixel data as DLn−1, the present high level print pixel data as DHn, and the previous high level print pixel data as DHn−1. In addition, * denotes a logical AND operation, + denotes an OR operation, and "not" denotes negation.

$$OI=(DHn+DLn)*\text{not}(DLn-1) \quad \text{(Logic expression A1)}$$

$$OII=(DHn+DLn)*\text{not}(DHn-1) \quad \text{(Logic expression A2)}$$

$$OIII=DHn \quad \text{(Logic expression A3)}$$

When each of the above logical results is "1"(true), the pulse is applied to the respective heating element.

Figure 12:
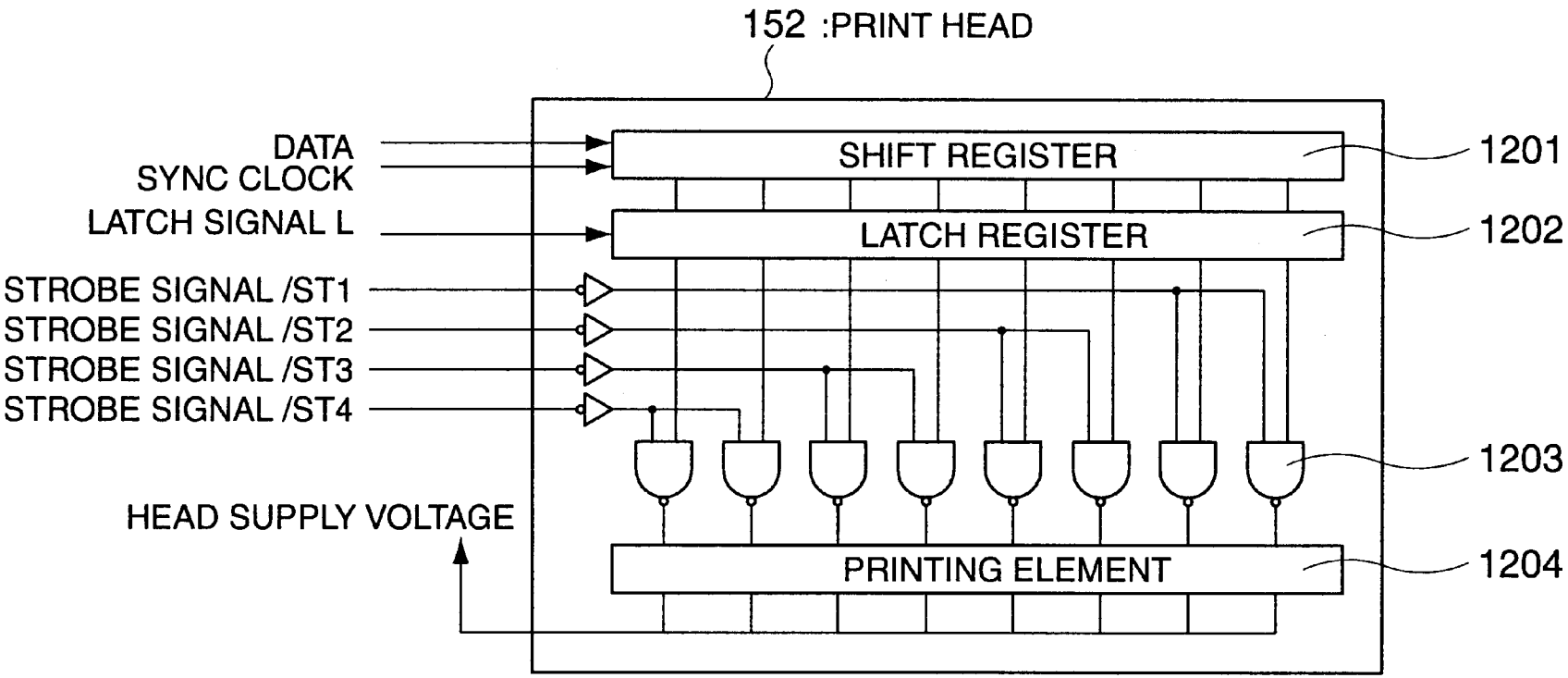
FIG. 12 is a block diagram of the print head in a printer according to the present invention.

FIG. 12 is a block diagram of a typical print head.

As shown in FIG. 12, the print head 152 has a printing element 1204 comprising plural heat elements, and functions as the heating unit for simultaneously printing one line of print pixel data. The print head 152 extends across the width of the thermal paper. The printing element 1204 is located at the leading edge of the print head 152. The plural heat elements of the printing element 1204 are selectively driven to produce heat and print one line of pixels on the thermal paper. The printing element 1204 is connected to plural drive circuits 1203 functioning as the heat element drivers for independently driving and heating the respective plural heat elements.

The drive circuits 1203 can be achieved with pnp transistors. When the drive circuits 1203 are selectively driven, the heat element connected to the driven drive circuit heats and produces color in that part of the thermal paper in contact with the driven heat element. The drive circuits 1203 are shown as NAND gates as a way of indicating the logic operation of the circuits. More specifically, when the strobe signal is not active (that is, is high), drive circuit 1203 operation is prohibited. Note that this circuit can be easily achieved by connecting the data and strobe signals (positive logic) to the base of the pnp transistors in a wired-OR configuration.

The inverse signal (positive logic) of the plural strobe signals (/St1 to /St4) generated by a delay circuit (not shown in the figure) and the data (positive logic) output from latch register 1202 are input to the drive circuits 1203, which are driven according to the level of both signals. More specifically, when a 1 meaning "print" is applied as the current pattern value, the strobe signal goes from high to low, becoming active, and the NAND gate drive circuit 1203 outputs low.

When the drive circuit 1203 outputs low, a potential difference results between the corresponding heat element and the head power supply, thus producing heat in the heat element. This heat pulse from the heat element is applied to the thermal paper in contact with the heat element, producing a colored pixel on the thermal paper. The strobe signal is supplied as a signal containing three or four pulses each having a different pulse width. A delay circuit can be used to shift the timing at which the plural strobe signals (/St1 to /St4) are applied. Problems associated with a supply voltage drop resulting from simultaneously supplying current to plural drive circuits can thus be avoided.

The print head 152 has a shift register 1201 and latch register 1202 functioning as a current pattern data storage unit for temporarily storing one line of current pattern data. One line of current pattern data for a specific interval is input to the shift register 1201 synchronized to the clock signal and held. The current pattern data indicates whether current is applied to the print pixels in that line in the specific interval, and is thus a bit train of 1s, meaning "supply current," and 0s meaning "do not supply current." The current pattern data is generated by applying a specific operation using the current print pixel data and the past print pixel data, and is input to the shift register 1201 at a specific time interval.

The latch register 1202 is parallel connected to the shift register 1201, and the bit data is simultaneously parallel shifted from the shift register 1201 to the corresponding storage area in the latch register 1202 and then held by the latch register 1202. It is therefore possible to input the present line of current pattern data for the next current apply time to the shift register 1201 while driving the heat elements based on the current pattern data in latch register 1202.

The transfer timing for shifting data from the shift register 1201 to the latch register 1202 is controlled by the input timing of a latch signal L to the latch register 1202. This latch signal L is output from a control circuit further described below. This timing is after the previous current apply time and before the present current apply time, and after the current pattern data for the present current apply time is stored in shift register 1201. Each storage area of the latch register 1202 is connected to one input terminal of a corresponding drive circuit 1203. Therefore, when new current pattern data is input to the latch register 1202 as a result of latch signal L being applied thereto, the input data to the drive circuits 1203 also changes immediately based on the content of the current pattern data. The drive circuits 1203 drive the corresponding heat elements in the printing element 1204 according to the current pattern data stored in latch register 1202 while the strobe signal is low (active).

The applied energy control unit of a thermal printer according to the present invention preferably has (a) plural paper type-base energy control units for controlling the applied energy level based on the type of thermal paper by controlling the current apply time for applying current to the print head, and (b) a control selection unit for selecting the most appropriate paper type-base energy control unit from among plural paper type-base energy control units based on the type of thermal paper in use.

Further preferably, the paper type-base energy control units of the thermal printer according to the present invention includes a two-color thermal paper-base energy control unit for producing a first color on two-color thermal paper based on a specific applied energy level in a first applied energy range that is greater than or equal to a specific first applied energy level and less than a specific second applied energy level, and produces a second color based on a specific applied energy level in a second applied energy range that is greater than or equal to the specific second applied energy level.

Yet further preferably, the two-color thermal paper control unit of the thermal printer according to the present invention controls printing color on a first two-color thermal paper and a second two-color thermal paper having mutually opposite applied energy characteristics such that the first two-color thermal paper produces color A as the first color and color B as the second color, and the second two-color thermal paper produces color B as the first color and color A as the second color, by interchanging the print pixel data for one color (color A or B) stored in a first color data buffer for storing print pixel data of a first color and the print pixel data of the other color (color A or B) stored in a second color data buffer for storing print pixel data of a second color using print pixel data containing two colors, A and B.

Yet further preferably, the two-color thermal paper control unit of the thermal printer according to the present invention has (a) a first control unit for printing color A and color B on a first two-color thermal paper using a first color data buffer for storing print pixel data for color A and a second color data buffer for storing print pixel data for color B, and (b) a second control unit for printing color A and color B on a second two-color thermal paper using a second color data buffer for storing print pixel data for color A and a first color data buffer for storing print pixel data for color B.

Figure 13:
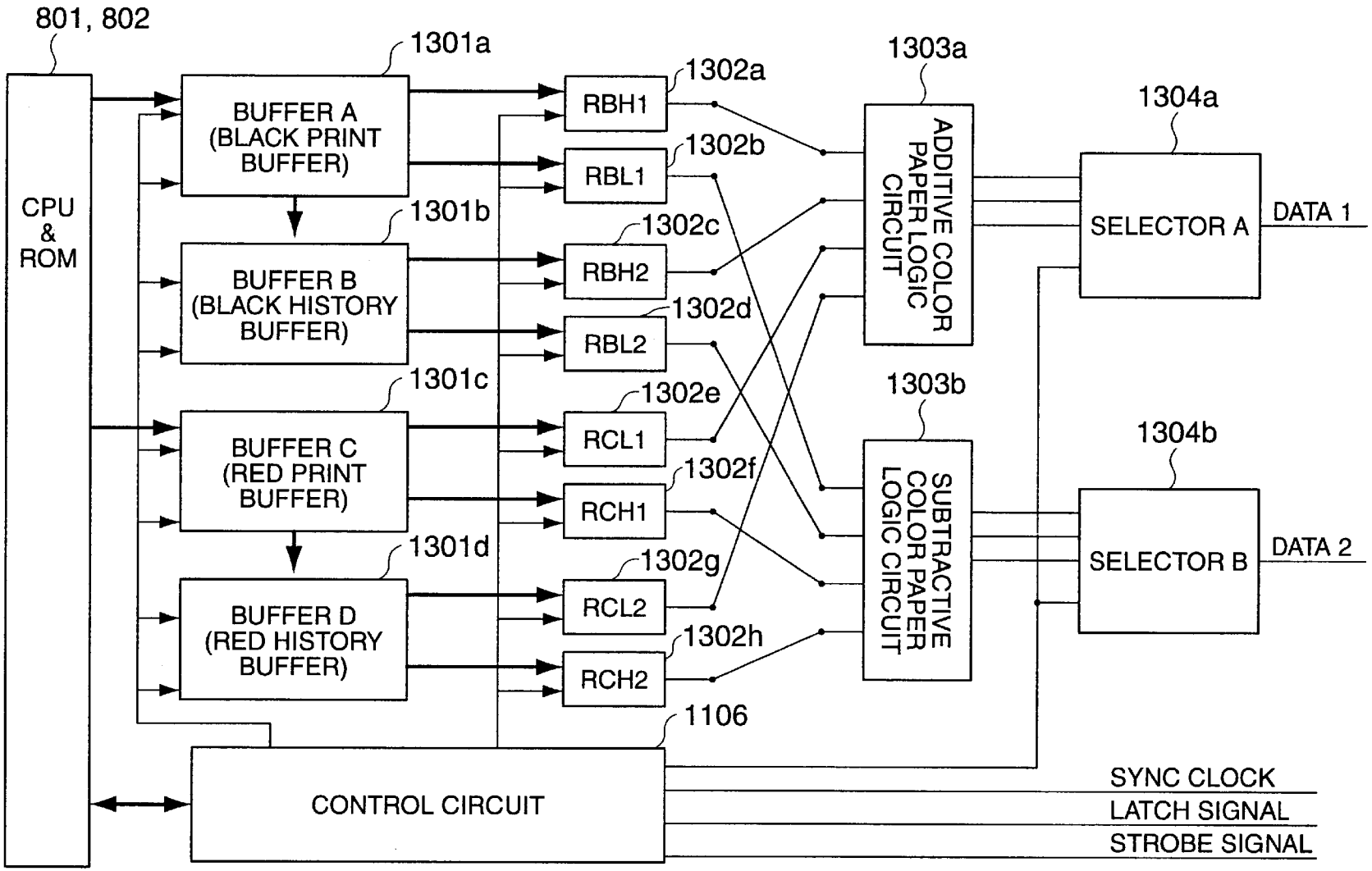
FIG. 13 is a control block diagram of a printer according to the present invention.

FIG. 13 is a control block diagram for another embodiment of the head control section according to the present invention.

The CPU 801 and ROM 802 sequentially transfer the print pixel data generated from the print data received from an application execution section (an application program) in the host computer 100 (FIG. 8) to storage buffers in the print head controller 811 by alternately sending one line of black print pixel data and one line of red print pixel data. Buffer A 1301*a* and buffer B 1301*b* store black print pixel data, and buffer C 1301*c* and buffer D 1301*d* store red print pixel data. Buffer A 1301*a* is the print buffer for storing the present line of black print pixel data, and buffer B 1301*b* is the history buffer storing the previous line of black print pixel data. Buffer C 1301*c* is the print buffer for storing the present line of red print pixel data, and buffer D 1301*d* is the history buffer storing the previous line of red print pixel data.

The CPU 801 and ROM 802 thus function as a memory allocation circuit based on a control program stored in ROM 802 (FIG. 8) to control storing print pixel data to the print buffers and transferring the print pixel data from the print buffers to the history buffers.

Based on a timing signal supplied from the control circuit 1106, the present line of black print pixel data stored in the print buffer A 1301*a* is stored in control register RBH1 1302*a* and control register RBL1 1302*b*, and the previous line of black print pixel data stored in the history buffer B 1301*b* is stored in control register RBH2 1302*c* and control register RBL2 1302*d*. Similarly, the present line of red print pixel data stored in print buffer C 1301*c* is stored in control register RCL1 1302*e* and control register RCH1 1302*f*, and the previous line of red print pixel data stored in the history buffer D 1301*d* is stored in control register RCL2 1302*g* and control register RCH2 1302*h*.

The print head controller 811 has two two-color logic circuits for additive color paper and subtractive color paper as the two-color thermal paper color control unit. Print pixel data stored in control register RBH1 1302*a*, control register RBH2 1302*c*, control register RCL1 1302*e*, and control register RCL2 1302*g* is input to additive color paper logic circuit 1303*a*, which applies a logic operation to the input data and outputs the resulting current pattern data. Print pixel data stored in control register RCH1 1302*f*, control register RCH2 1302*h*, control register RBL1 1302*b*, and control register RBL2 1302*d* is input to the subtractive color paper logic circuit 1303*b*, which applies a logic operation to the input data and outputs the resulting current pattern data. Based on the thermal paper type mode, selector A 1304*a* and selector B 1304*b* sequentially output the logic result passed from additive color paper logic circuit 1303*a* or from subtractive color paper logic circuit 1303*b* as the current pattern data to the print head.

It will be apparent that the thermal paper type mode can be first evaluated so that only the process for storing the print pixel data to control register RBH1 1302*a*, control register RBH2 1302*c*, control register RCL1 1302*e*, and control register RCL2 1302*g* and outputting the current pattern data from the additive color paper logic circuit 1303*a*, or the process for storing the print pixel data to control register RBL1 1302*b*, control register RBL2 1302*d*, control register RCH1 1302*f*, and control register RCH2 1302*h* and outputting the current pattern data from the subtractive color paper logic circuit 1303*b*, is run. It is also possible to store the data in all of the control registers, obtain the output of the logic operations applied by the additive color paper logic circuit 1303*a* and subtractive color paper logic circuit 1303*b*, and then select the appropriate output as the current pattern data based on the thermal paper type mode. Note that the two-color logic circuits are described in further detail with reference to FIG. 14 to FIG. 17 and FIG. 21.

Figure 21:
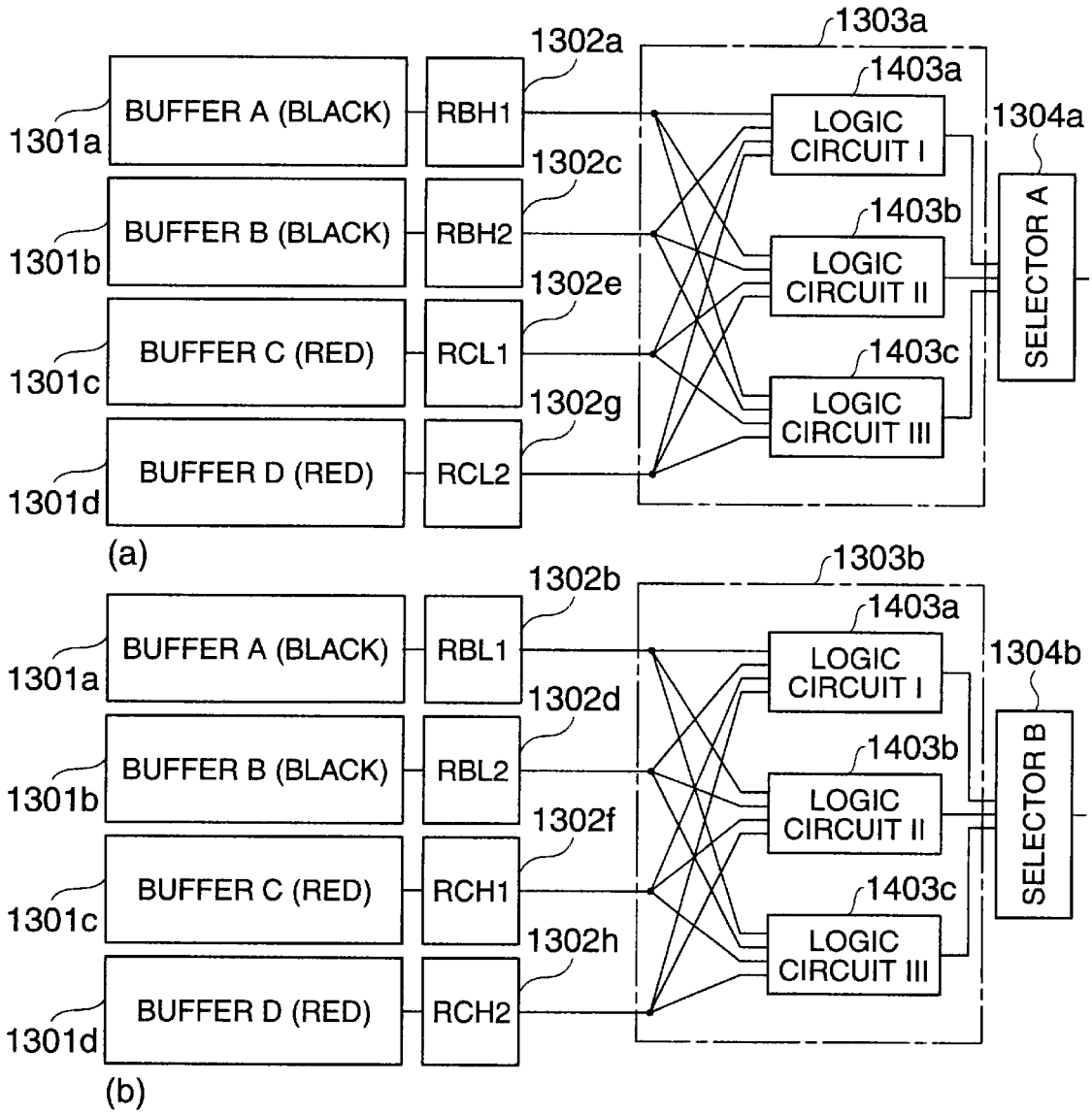
FIG. 21A shows the internal configuration of a logic circuit for printing on additive color paper.
FIG. 21B shows the internal configuration of a logic circuit for printing on subtractive color paper.

FIG. 21 is a block diagram showing the internal configuration of a two-color logic circuit. FIG. 21A shows the internal configuration of a logic circuit for additive color paper, and FIG. 21B shows the internal configuration of a logic circuit for subtractive color paper.

In this embodiment, colors are black and red and the logical expressions are the same as the above logical expressions A1, A2 and A3.

Therefore, if the present red print pixel data is Cn, the previous red print pixel data is Cn−1, the present black print pixel data is Bn, and the previous black print pixel data is Bn−1, the present black print pixel data Bn, previous black print pixel data Bn−1, present red print pixel data Cn, and previous red print pixel data Cn−1 stored in control register RBH1 1302*a*, control register RBH2 1302*c*, control register RCL1 1302*e*, and control register RCL2 1302*g* is input as shown in FIG. 21A to the additive color paper logic circuit 1303*a*, which then outputs current pattern data based on the following logic equations.

$$OI=(Bn+Cn)*\mathrm{not}(Cn-1)$$

$$OII=(Bn+Cn)*\mathrm{not}(Bn-1)$$

$$OIII=Bn$$

Furthermore, as shown in FIG. 21B, the present black print pixel data Bn, previous black print pixel data Bn−1, present red print pixel data Cn, and previous red print pixel data Cn−1 stored in control register RBL1 1302*b*, control register RBL2 1302*d*, control register RCH1 1302*f*, and control register RCH2 1302*h* is input to subtractive color paper logic circuit 1303*b*, which then outputs current pattern data based on the following logic equations.

$$OI=(Bn+Cn) * \mathrm{not}(Bn-1)$$

$$OII=(Bn+Cn) * \mathrm{not}(Cn-1)$$

$$OIII=Cn$$

For example, if the previous print pixel data is for red and the present print pixel data is for black, that is, if Bn=1, Bn−1=0, Cn=0, and Cn−1=1, logic circuit I 1403*a*, logic circuit II 1403*b*, and logic circuit III 1403*c* will output OI=0, OII=1, and OIII=1, respectively, in the case of additive color paper logic circuit 1303*a*, and OI=1, OII=0, and OIII=0 in the case of subtractive color paper logic circuit 1303*b*.

Note that if there is no previous print pixel data, that is, when operating on the first print pixel data, these logic operations assume a value of 0 for the previous print pixel data.

Output from logic circuit I 1403*a*, logic circuit II 1403*b*, and logic circuit III 1403*c* is passed by selector 1404 to print head 152 sequentially from OI. In the above example, therefore, the bit sequence 011 is applied to the print head 152 for one dot (heat element) in the case of additive color paper logic circuit 1303*a*, and the bit sequence 100 is applied in the case of subtractive color paper logic circuit 1303*b*. In this example the current apply time is divided into three pulse periods and each bit corresponds to one pulse period. As further described with reference to FIG. 15 and FIG. 16, the control circuit 1106 shown in FIG. 11 successively outputs three pulses PI, PII, and PIII each with a different pulse width as the strobe signal. One or more of at least three pulses are selected to form the current apply time, and each current apply time pulse width is thus modulated.

Figure 15:
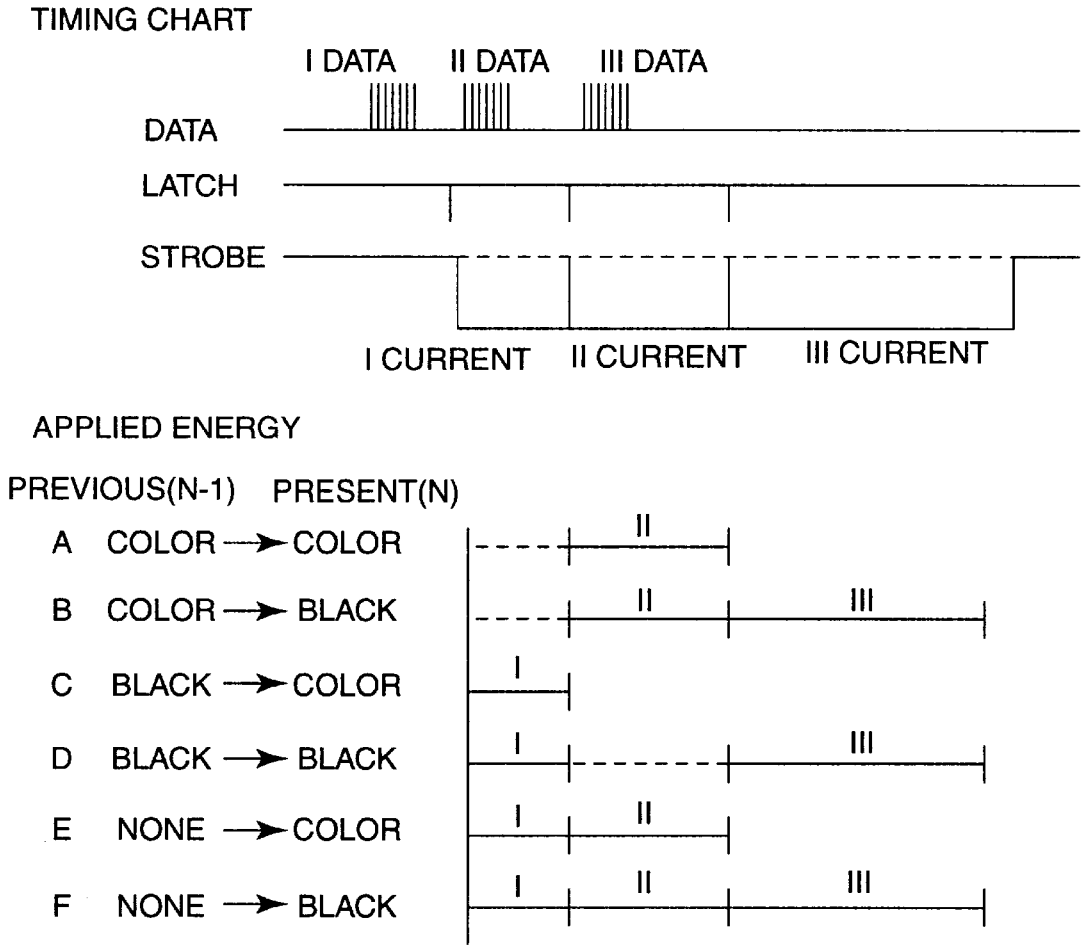
FIG. 15A shows combinations of energizing currents applied according to the combination of present print pixel data and previous print pixel data in an additive color paper logic circuit.
FIG. 15B shows modulations of pulse current signals containing three pulses of different pulse widths in an additive color paper logic circuit.

FIG. 15 shows the relationship between three pulses of different pulse widths and the print pixel data in a logic circuit for additive color paper. FIG. 15A shows different energizing combinations achieved by combining the present print pixel data and the previous print pixel data. FIG. 15B shows the different current patterns producing different applied energy levels as a result of applying one or more three pulses of different pulse widths in different patterns.

As noted above, the control circuit 1106 successively outputs pulses PI, PII, and PIII each with a different pulse width based on data output from the additive color paper logic circuit 1303*a*. The ratio between the pulse widths of pulses PI, PII, and PIII can be experimentally determined.

As shown in FIG. 15A, six applied energy combinations (cases A to F) must be considered based on the current applied according to the previous print pixel data and the present print pixel data. As shown in FIG. 15B, the six kinds of energizing currents for the different applied energy levels are determined by selecting one or more widths of pulses PI, PII, and PIII.

For example, if the previous print pixel data is for red and the present print pixel data is for black (case B in FIG. 15), pulses PII and PIII are applied to determine the next applied energy level. This means that, as described above, the bit train 011 is applied as the current pattern data for one dot to the print head 152.

Figure 16:
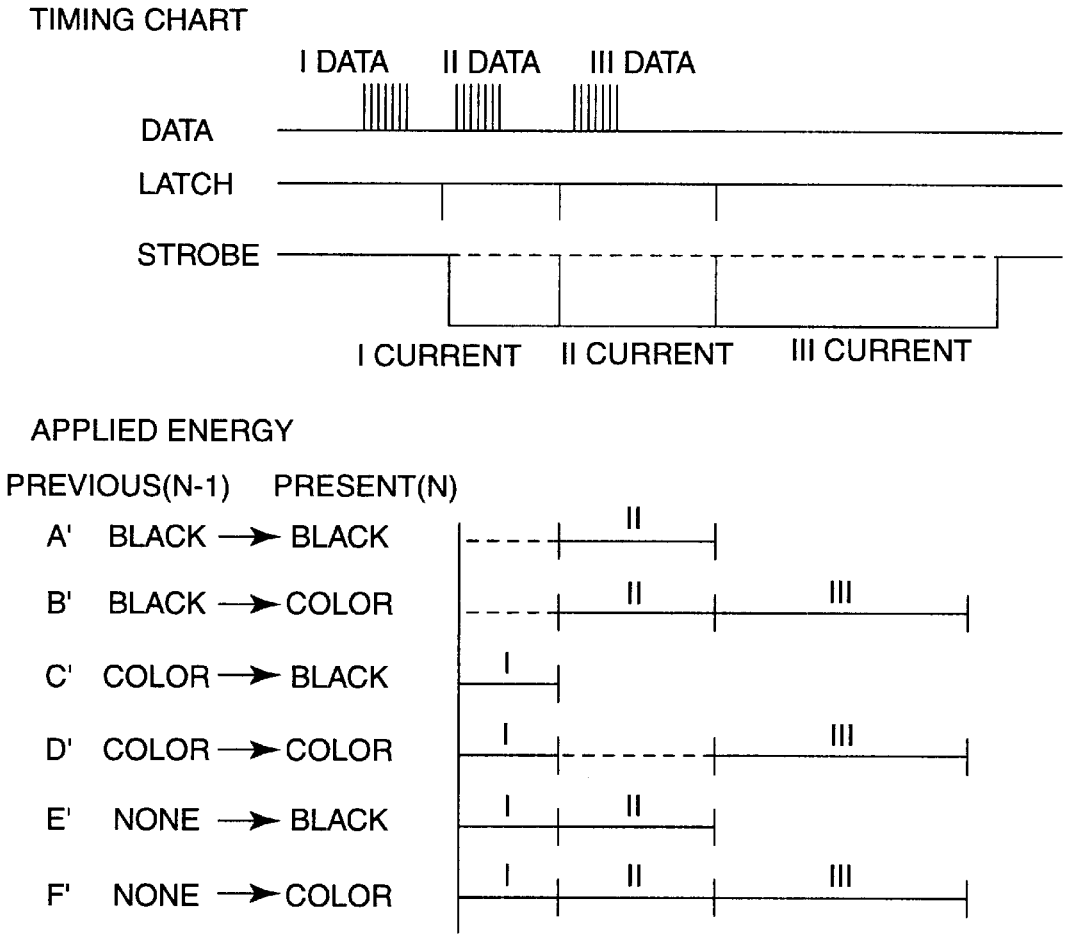
FIG. 16A shows combinations of energizing current applied according to the combination of present print pixel data and previous print pixel data in a subtractive color paper logic circuit.
FIG. 16B shows modulations of pulse current signals containing three pulses of different pulse widths in a subtractive color paper logic circuit.

FIG. 16 shows the relationship between three pulses of different pulse widths and the print pixel data in a logic circuit for subtractive color paper. FIG. 16A shows different energizing patterns achieved by taking account the present print pixel data and the previous print pixel data. FIG. 16B shows the different current patterns producing different applied energy levels as a result of selectively applying one, two or three pulses of different pulse widths in different patterns.

As noted above, the control circuit 1106 successively outputs pulses PI, PII, and PIII each with a different pulse width based on data output from the subtractive color paper logic circuit 1303*b*.

As shown in FIG. 16A, six applied energy modulations (cases A' to F') must be considered based on the current applied according to the previous print pixel data and the present print pixel data. As shown in FIG. 16B, the six modulations of energizing current for the different applied energy levels are determined according to pulse widths of pulses PI, PII, and PIII (shown as I, II, III in FIG. 16B).

For example, if the previous print pixel data is for red and the present print pixel data is for black (case C' in FIG. 16), only pulse PI is applied to determine the next applied energy level. This means that, as described above, the bit train 100 is applied as the current pattern data for one dot to the print head 152.

Figure 17:
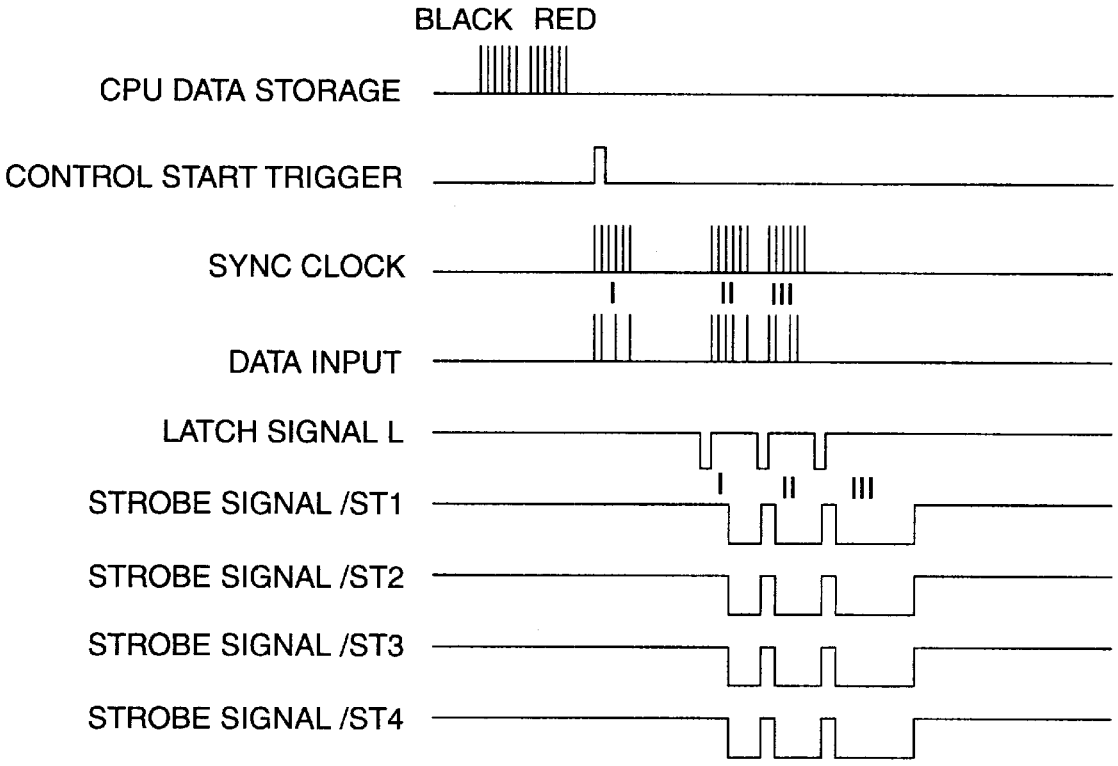
FIG. 17 is a timing chart of control signals for two-color printing.

FIG. 17 is a timing chart of the control signals used for two-color printing.

As shown in FIG. 17, the print pixel data for one line in two-color printing includes both black print pixel data and red print pixel data, which is sequentially sent from the host computer 100 (FIG. 8). The data is received by a receiving circuit (not shown in the figure) and stored from there in buffer A 1301*a* and buffer C 1301*c* by CPU 801 (CPU data storage). The current pattern data resulting from the logic operation applied by standard two-color logic circuit 1400 is then applied to shift register 1201 of print head 152 based on the control start trigger from control circuit 1106 (data input). The current pattern data from logic circuit I 1403*a* is applied as the first data input signal, and the current pattern data from logic circuit II 1403*b* and logic circuit III 1403*c* is then applied at the specified timing.

When the current pattern data from logic circuit I 1403*a* is applied to the data input line, the current pattern data is latched by latch register 1202 at latch signal L and applied to drive circuit 1203. Pulse PI is then applied to the strobe signal (/St1 to /St4), and the drive circuit 1203 is driven according to the data sequence held in the latch register 1202.

Parallel to applying pulse PI to strobe signal (/St1 to /St4), the current pattern data from logic circuit II 1403*b* is applied to the shift register 1201. The current pattern data from logic circuit II 1403*b* then replaces the data previously stored in latch register 1202 at the next latch signal L. Pulse PII is then applied to strobe signal (/St1 to /St4), and drive circuit 1203 is driven according to the data sequence held in latch register 1202. A similar control sequence next drives the drive circuit 1203 for pulse PIII of the strobe signal (/St1 to /St4) according to the current pattern data output from logic circuit III 1403*c*. This operation results in printing one line of dots.

The printer of the present invention described above can also print on monochrome thermal paper as described below with reference to FIG. 18 and FIG. 19.

Figure 18:
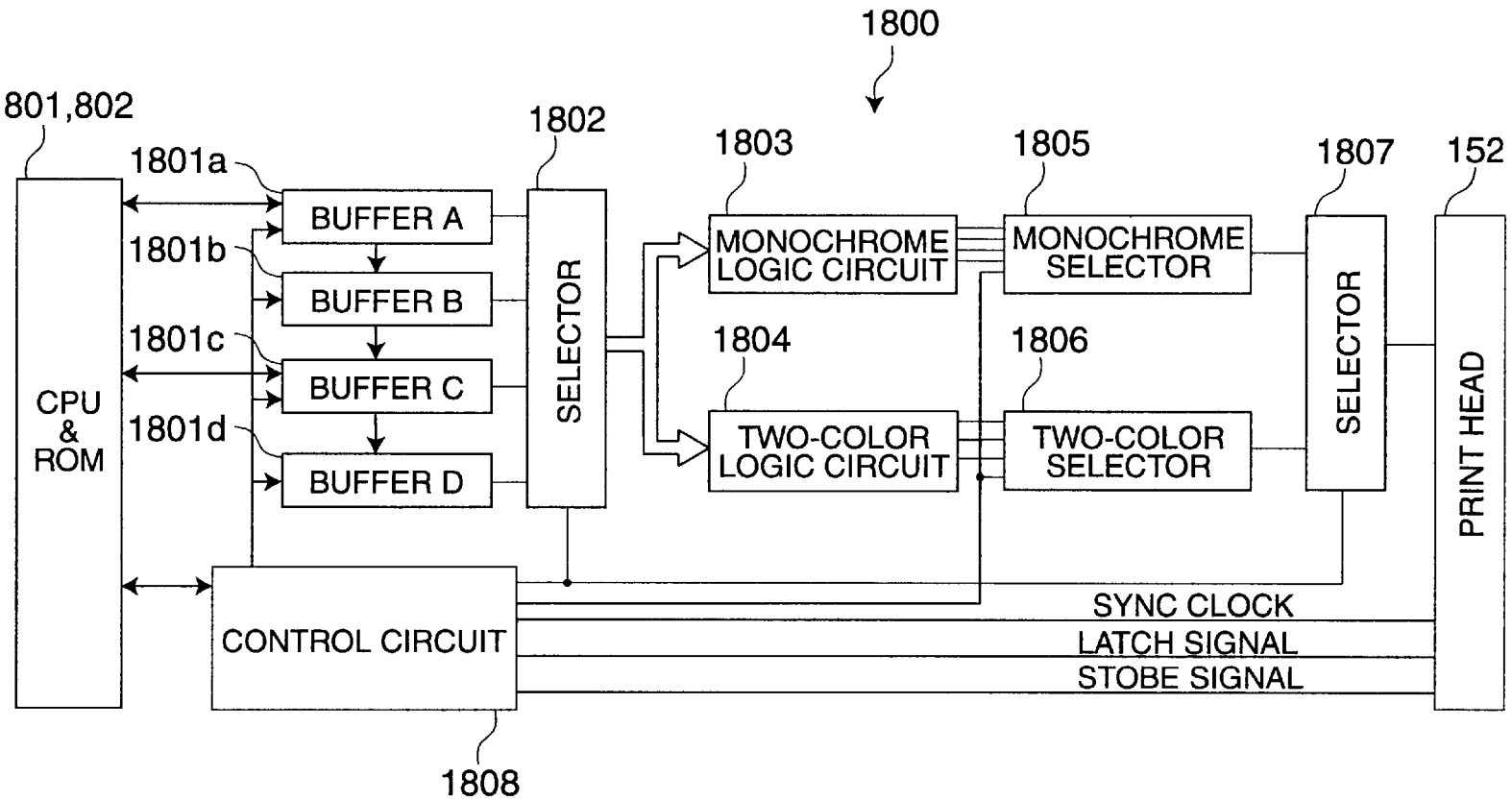
FIG. 18 is a control block diagram for a printer that can use monochrome thermal paper and two-color thermal paper.

FIG. 18 is a control block diagram of a printer that can use monochrome thermal paper as well as two-color thermal paper.

Controlling a printer that can use both additive color and subtractive color two-color thermal paper has been described above with reference to FIG. 13 and FIG. 14. This printer can also be controlled to print with monochrome thermal paper as described next below.

As shown in FIG. 18, if the thermal paper type mode is monochrome thermal paper, the present print pixel data is stored in buffer A 1801*a*, and previous print pixel data from the last line, from two lines before, and from three lines before is stored in buffer B 1801*b*, buffer C 1801*c*, and buffer D 1801*d*, respectively. The previous print pixel data is stored by sequentially shifting data from buffer A 1801*a* to buffer B 1801*b*, from buffer B 1801*b* to buffer C 1801*c*, and from buffer C 1801*c* to buffer D 1801*d*.

The print pixel data stored in buffer A 1801*a*, buffer B 1801*b*, buffer C 1801*c*, and buffer D 1801*d* is input by selector 1802 through control registers to monochrome logic circuit 1803. Data output from monochrome logic circuit 1803 is sequentially output by monochrome selector 1805 to selector 1807 as the current pattern data based on a timing signal from control circuit 1808.

The two-color logic circuit 1804 can be configured using only one logic circuit instead of two, additive color paper logic circuit 1303*a* and subtractive color paper logic circuit 1303*b*, as shown in FIG. 13. In this case selector 1802 inputs the print pixel data to standard two-color logic circuit 1400 shown in FIG. 14, and stores the present high level print pixel data, previous high level print pixel data, present low level print pixel data, and previous low level print pixel data in control register RH1 1402*a*, control register RH2 1402*b*, control register RL1 1402*c*, and control register RL2 1402*d*, respectively.

Figure 19:
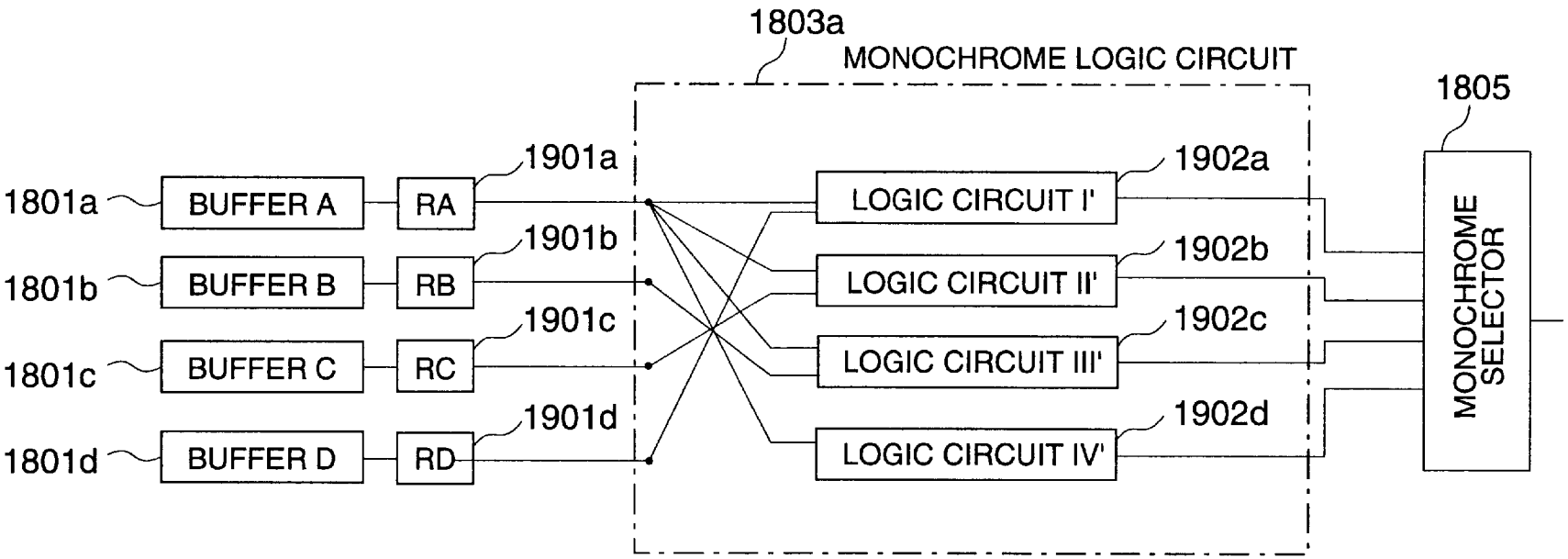
FIG. 19 is a block diagram showing the internal configuration of a logic circuit for monochrome printing.

FIG. 19 is a block diagram showing the internal configuration of a monochrome logic circuit by way of example.

As shown in FIG. 19 the monochrome logic circuit 1803 has four logic circuits, logic circuit I' 1902*a*, logic circuit II' 1902*b*, logic circuit III' 1902*c*, and logic circuit IV' 1902*d*. At a specific timing controlled by control circuit 1808, the logic circuits read the print pixel data input from buffer A 1801*a*, buffer B 1801*b*, buffer C 1801*c*, and buffer D 1801*d* to control register RA 1901*a*, control register RB 1901*b*, control register RC 1901*c*, and control register RD 1901*d*, apply the logic operations shown in the following equations, and output the resulting current pattern data. The output data from logic circuit I' 1902*a*, logic circuit II' 1902*b*, logic circuit III' 1902*c*, and logic circuit IV' 1902*d* is denoted below as OI', OII', OIII', and OIV', respectively. Furthermore, the present print pixel data stored in control register RA 1901*a* is denoted as Dn, the first previous print pixel data stored in control register RB 1901*b* as Dn−1, the second previous print pixel data stored in control register RC 1901*c* as Dn−2, and the third previous print pixel data stored in control register RD 1901*d* as Dn−3. In addition, * denotes a logical AND operation and "not" denotes negation.

$$OI'=Dn*\text{not}(Dn_3)$$

$$OII'=Dn*\text{not}(Dn_2)$$

$$OIII'=Dn*\text{not}(Dn_1)$$

$$OIV'=Dn$$

In this case the output current pattern data corresponds to one of four pulse periods in the current apply time. The control circuit 1808 successively outputs four pulses PI', PII', PIII', and PIV', each having a different pulse width, as the strobe signal.

A printing control method according to the present invention has (a) a data receiving step for receiving print data sent from a host computer, (b) a print pixel data storage step, (c) an applied energy control step, and (d) a printing control step. The print pixel data storage step extracts the print pixel data for each printed color from the print data received by the data receiving step, and stores the pixel data in specific data buffers. The applied energy control step controls the applied energy level, that is, the amount of energy to apply to a particular pixel to produce a particular color in the thermal paper, based on the specified type of thermal paper and the print pixel data for each color pixel stored by the print pixel data storage step. The printing control step drives the print head to produce a particular color in a specified area of the thermal paper based on the current pattern data, which indicates the applied energy level set by the applied energy control step.

The applied energy control step of this printing control method preferably has (a) plural paper type control steps for controlling the applied energy level based on the type of thermal paper by controlling the current apply time of the printing control step, and (b) a control selection step for selecting a most appropriate paper type control step from among plural paper type control steps based on the type of thermal paper in use.

Further preferably, the paper type control steps of this printing control method have a two-color thermal paper control step for producing a first color on two-color thermal paper based on a specific applied energy level in a first applied energy range that is greater than or equal to a specific first applied energy level and less than a specific second applied energy level, and produces a second color based on a specific applied energy level in a second applied energy range that is greater than or equal to the specific second applied energy level.

Yet further preferably, the two-color thermal paper control step of this printing control method controls printing color on a first two-color thermal paper and a second two-color thermal paper having mutually opposite applied energy characteristics such that the first two-color thermal paper produces color A as the first color and color B as the second color, and the second two-color thermal paper produces color B as the first color and color A as the second color, by interchanging the print pixel data for one color (color A or B) stored in a first color data buffer for storing print pixel data of a first color and the print pixel data of the other color (color A or B) stored in a second color data buffer for storing print pixel data of a second color using print pixel data containing two colors, A and B.

Yet further preferably, the two-color thermal paper control step of this printing control method has (a) a first control step for printing color A and color B on a first two-color thermal paper using a first color data buffer for storing print pixel data for color A and a second color data buffer for storing print pixel data for color B, and (b) a second control step for printing color A and color B on a second two-color thermal paper using a second color data buffer for storing print pixel data for color A and a first color data buffer for storing print pixel data for color B.

The paper type-base energy control step of this printing control method can control the current apply time of the printing control step by selecting one or more predetermined pulse current periods based on the color of the present print pixel data to be formed on the thermal paper by the printing control step, and the color of the previous print pixel data formed on the thermal paper.

Further preferably, the printing control step of this printing control method has (a) a heating step for producing a color in a specific area of the thermal paper, (b) a heating drive step disposed for each heating step for driving the heating step, and (c) a current pattern data storage step for storing the current pattern data output from the applied energy control step.

Yet further preferably, the printing control method of this invention also has (a) a paper type detection step for determining the type of thermal paper loaded in the printer, and (b) paper type storage step for storing the type of thermal paper identified by the paper type detection step.

Furthermore, the type of thermal paper used in this printing control method is monochrome thermal paper, two-color subtractive color thermal paper, or two-color additive color thermal paper.

Figure 20:
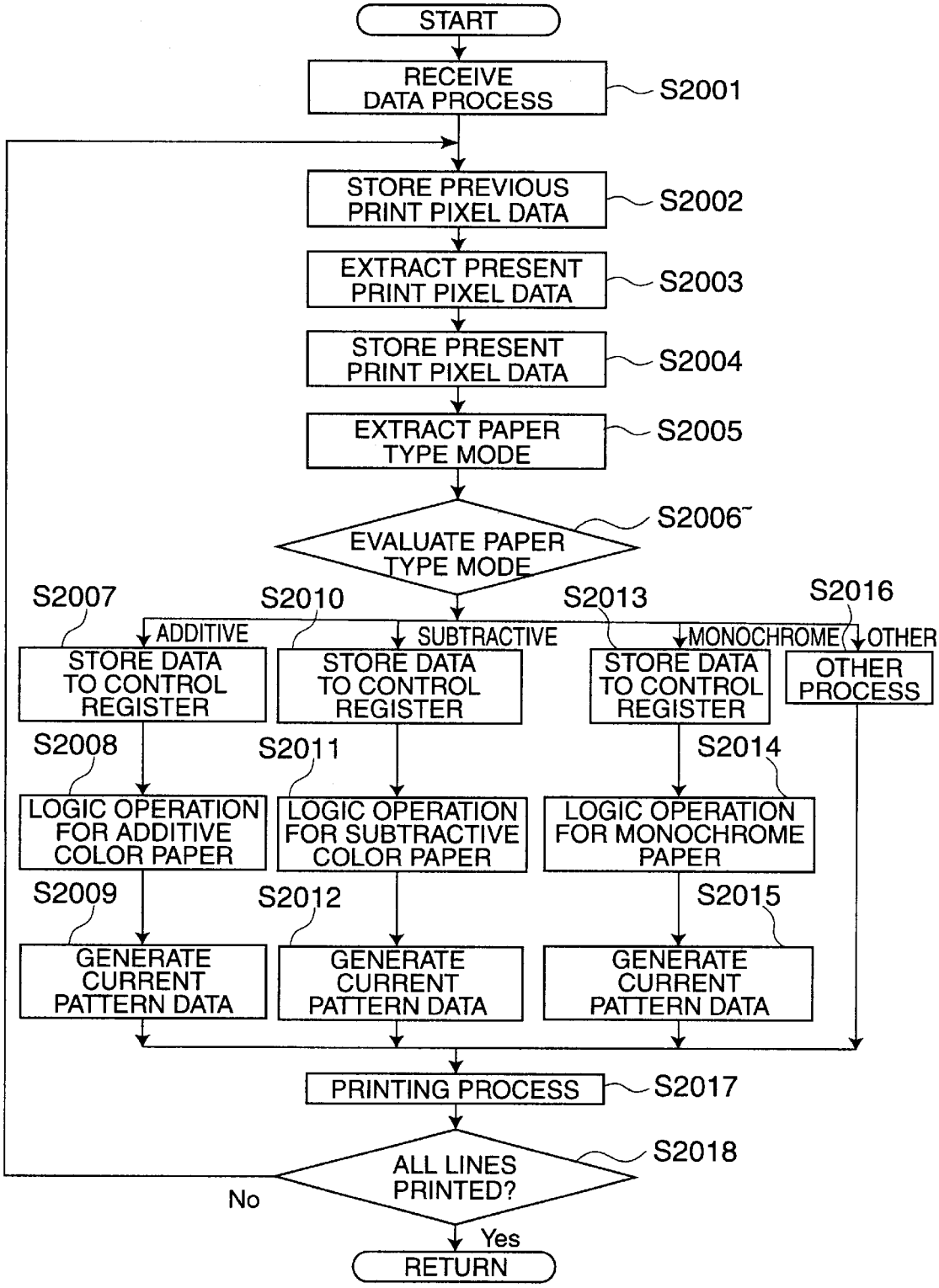
FIG. 20 is a flow chart of the printing process according to the present invention.

FIG. 20 is a flow chart of the printing process.

When print data is received from the host computer, print pixel data is generated from the received print data and stored in specific data buffers (S2001).

The previously printed line of print pixel data for each color is then transferred from the print buffer to the history buffer (S2002). If there is no print pixel data for a print color in the previous line, a null value is stored.

The print pixel data for each color in the present print line is then extracted from the stored print pixel data (S2003), and the extracted print pixel data for each color is stored in the print buffer (S2004).

The thermal paper type mode indicating the type of thermal paper in use is then extracted (S2005) and evaluated (S2006).

If the thermal paper type mode indicates additive color paper (S2006 returns "additive"), the print pixel data.for each print color stored in the print buffer and history buffer is stored in the control registers specified for each buffer and print color (S2007).

A logic operation for printing on additive color paper is then applied to the print pixel data stored in the control registers (S2008), the current pattern data for the print process is generated from the result of the logic operation (S2009), and control then advances to the print process in step S2017.

If the thermal paper type mode indicates subtractive color paper (S2006 returns "subtractive"), the print pixel data for each print color stored in the print buffer and history buffer is stored in the control registers specified for each buffer and print color (S2010).

A logic operation for printing on subtractive color paper is then applied to the print pixel data stored in the control registers (S2011), the current pattern data for the print process is generated from the result of the logic operation (S2012), and control then advances to the print process in step S2017.

If the thermal paper type mode indicates monochrome paper (S2006 returns "monochrome"), the print pixel data stored in the print buffer and history buffer is stored in the control registers specified for each buffer and print color (S2013).

A logic operation for printing on monochrome paper is then applied to the print pixel data stored in the control registers (S2014), the current pattern data for the print process is generated from the result of the logic operation (S2015), and control then advances to the print process in step S2017.

If the thermal paper type mode indicates another type of thermal paper (S2006 returns "other"), a logic operation appropriate to the thermal paper is applied, the current pattern data for the print process is generated from the result of the logic operation (S2016), and control then steps to the print process in step S2017.

The print process for one line is then run using the current pattern data (S2017).

Whether the print process has been completed for all lines is then determined (S2018), and the printing process ends if all lines have been processed (S2018 returns yes). If not all lines have been printed (S2018 returns no), control loops back to step S2002 and the process repeats for the present line.

A data storage medium according to the present invention records (stores) a computer-executable program for executing the steps of the various printing control methods of the invention described above.

This data storage medium can be a Compact Disc (CD), floppy disk, hard disk, magneto-optical disk, Digital Versatile/Video Disc (DVD), magnetic tape, memory card, or other computer readable storage medium.

Advantages of the present invention are described below.

A thermal printer of this invention can control printing according to the type of thermal paper loaded in the printer as a result of determining the type of thermal paper placed in the printer when the paper supply is changed. The printer preferably has way of identifying the type of thermal paper loaded into the printer when the paper is replaced. However, a printer that can control printing according to the type of thermal paper loaded in the printer when the apparatus or method for identifying the type of thermal paper is unable to identify the paper type, or when the printer is not provided with such a feature, can also be provided by incorporating into the printer driver a function enabling the user to select the thermal paper type.

The invention also provides a thermal printer that can control printing according to the type of thermal paper loaded in the printer by specifying the print pixel data buffers for separately storing print pixel data for each print color in the print data received from the host computer according to the type of thermal paper in the printer, and controlling the applied energy used to print the colors according to the type of thermal paper.

Furthermore, by thus controlling printing according to the type of thermal paper used, the present invention provides a thermal printer that can use different types of thermal paper, including whichever type of thermal paper is most commonly available.

Moreover, because the printer of this invention can use different types of thermal paper, the user can purchase and use whatever type of thermal paper is most common and least expensive.

The present invention thus provides a printer that is extremely convenient and economical to operate for the end user.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printing system comprising:

a thermal print head having a plurality of heating elements, a paper information storing section that designates a paper type selected from additive two color thermal paper and subtractive two color thermal paper, a first pulse width modulation section for selectively controlling the energy to be applied to each heating element in accordance with energy levels required to obtain the two colors of the subtractive two-color thermal paper, a second pulse width modulation section for selectively controlling the energy to be applied to each heating element in accordance With energy levels required to obtain the two colors of the additive two-color thermal paper, and a buffer selector for selecting either the first or the second pulse width modulation section based on said paper type information.

2. The system of claim 1 further comprising a paper type determining unit that includes an input control unit that selects either an automatic determining mode or a manual-determining mode.

3. The system of claim 2, wherein the paper type determining unit includes a printing control unit that performs printing by energizing the thermal print head with at least two predetermined levels of applied energy and a printed color detection control unit that reads the printed result to detect the color.

4. The system of claim 1 further comprising:

a data receiving section that receives the print data from a host computer, a paper information memory section that stores at least a relationship between first and second colors and different energy levels to be applied to produce each of the colors, a first print data storing memory section that stores print data for the first color which can be produced by a low energy level, a second print data storing memory section that stores print data for the second color which can be produced by a high energy level, a data input control unit that determines which one of the print data storing memory sections will be used to store received print data based on the information stored in the paper information memory section when the print data is received from the host computer, a pulse generating section that generates at least three pulses, a history data storing section that stores at least one occurrence of previous print data of each color, a logic circuit that produces a current time period for driving each heating element by selecting one or more pulses corresponding to the present print data and the history data, and a driving section that drives each heating element with a low energy level in accordance with the data stored in the first print data storing memory and with a high energy level in accordance with the data stored in the second print data memory section.

5. The system of claim 4, wherein the data input control unit includes an address exchanging unit that exchanges the addresses of the print data storing memories based on the information stored in the paper information memory section that designates the type of the thermal paper.

6. The system of claim 5, wherein the paper information memory section designates one of the paper types including subtractive color thermal paper and additive color thermal paper.

7. The system of claim 1 further comprising:

a printer, and a host computer comprising:

a print data receiving unit that receives print data from an application program on a host computer, a first print data storing memory that stores the first color print data of a first color produced by a low energy level, a second print data storing memory that stores the second print data of a second color produced by a high energy level, a data storing control unit that selects one of the first and second print data storing memories when inputting the first or second color print data based on the information stored in the paper information storing section, and a printer driver that selectively sends the color print data to the printer.

8. A printing control method for controlling a thermal printer comprising:

receiving a print request and print data from an application program, storing the received print data for each color of at least first and second colors in a predetermined memory section to define first and second color print data, determining a type of a paper installed in the printer, determining each color print data to be produced by a low energy level or high energy level, storing the first color print data in a first print data storing buffer to be energized by a predetermined low energy level, storing the second color print data in a second print data storing buffer to be energized by a predetermined high energy level, controlling a heating element by driving the heating element in accordance with the color print data stored in the first print data storing buffer in a predetermined first current time period and driving the heating element in accordance with the color print data stored in the second print data storing buffer in a predetermined second current time period that is greater than the first current time period.

9. A machine-readable data storage medium carrying a program of instructions for execution by the machine to perform the printing control method steps of claim 8.

10. The medium of claim 9 comprising a computer readable medium including one of a Compact Disc (CD), floppy disk, hard disk, magneto-optical disk, Digital Versatile/Video Disc (DVD), magnetic tape, and memory card.

* * * * *